US009156601B2

(12) United States Patent
Tani

(10) Patent No.: US 9,156,601 B2
(45) Date of Patent: Oct. 13, 2015

(54) APPLICATION MATERIAL EXTRUDING CONTAINER

(71) Applicant: TOKIWA CORPORATION, Nakatsugawa-shi, Gifu (JP)

(72) Inventor: Yoshikazu Tani, Kawaguchi (JP)

(73) Assignee: TOKIWA CORPORATION, Gifu (JP)

( * ) Notice: Subject to any disclaimer, the term of this patent is extended or adjusted under 35 U.S.C. 154(b) by 323 days.

(21) Appl. No.: 13/845,906

(22) Filed: Mar. 18, 2013

(65) Prior Publication Data

US 2013/0279965 A1 Oct. 24, 2013

(30) Foreign Application Priority Data

Apr. 23, 2012 (JP) ..... 2012-097831

(51) Int. Cl.
*B65D 83/00* (2006.01)
*A45D 34/04* (2006.01)

(52) U.S. Cl.
CPC ..... *B65D 83/0005* (2013.01); *A45D 34/04* (2013.01); *A45D 2200/053* (2013.01); *A45D 2200/055* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,570,013 | A * | 1/1926 | Smith | 132/114 |
| 5,219,448 | A * | 6/1993 | Hackmann | 401/176 |
| 7,806,612 | B1 * | 10/2010 | Wangler | 401/11 |
| 2012/0076568 | A1 | 3/2012 | Tani | |

FOREIGN PATENT DOCUMENTS

| | | | |
|---|---|---|---|
| JP | 2006-102076 | A | 4/2006 |
| JP | 2012-050884 | A | 3/2012 |

* cited by examiner

*Primary Examiner* — David Walczak
(74) *Attorney, Agent, or Firm* — Bacon & Thomas, PLLC

(57) ABSTRACT

An application material extruding container has a filling member including a filling area filled with an application material, a piston inward inserted to the filling member in a rear end of the filling area, and a hole portion arranged in the filling member. A front end surface of the piston is arranged in front of a rear end of an opening of the hole portion when the piston is at a backward moving limit, and a part of the application material is flowed out of the filling area while passing through the hole portion. When the piston is assembled in the filling member, the piston is inward inserted to the filling member while securely discharging an air between the application material and the piston out of the filling area via the hole portion, until the application material is flowed out of the filling area via the hole portion.

15 Claims, 16 Drawing Sheets

APPLICATION MATERIAL EXTRUDING CONTAINER

BACKGROUND OF THE INVENTION

1. Field of the Invention

The present invention relates to an application material extruding container which is used by extruding an application material.

2. Description of the Conventional Art

As a conventional application material extruding container, for example, a structure described in JP-A-2006-102076 has been known. The application material extruding container described in JP-A-2006-102076 is provided with a tubular filling member (a storage portion) which is formed by setting one end as an opening portion and setting the other end as an application wall having a discharge port for an application material, and arranging a concave groove on an inner peripheral surface in the opening portion side, and the application material which is filled in a filling area within the filling member, and an extruding portion (an inner tray) which comes into close contact with an inner periphery of the filling member.

SUMMARY OF THE INVENTION

Problem to be Solved by the Invention

In the application material extruding container as mentioned above, when the extruding portion is assembled in the filling member in which the application material is filled, the extruding portion can be inserted to the filling member while excluding air between the extruding portion and the application material via the concave groove, thereby designing to inhibit the air from standing between the application material and the extruding portion. In this view point, in the application material extruding container in recent years, in order to further suppress a risk that the application material discharges (leaks) in an unintended manner from the discharge port, for example, due to a temperature change, it is desired to more securely prevent the air from standing between the application material and the extruding portion.

Accordingly, an object of the present invention is to provide an application material extruding container which more securely inhibits the air from standing between an application material and an extruding portion.

Means for Solving the Problem

In order to achieve the object mentioned above, according to the present invention, there is provided an application material extruding container comprising:

a filling member which has a filling area filled with an application material;

an extruding portion which is inward inserted to the filling member so as to be in close contact with the filling member and constructs a rear end of the filling area; and the application material extruding container discharging the application material from a discharge port in a leading end side of the container on the basis of a forward movement of the extruding portion, wherein the application material extruding container comprises a passage portion which is provided in the filling member and extends so as to be communicated with an external side of the filling member in the container from the filling area, wherein at least a part of the extruding portion is arranged in front of a rear end of an opening closer to the filling area in the passage portion, and wherein a part of the application material is flowed out of the filling area through the passage portion.

In the application material extruding container, a part of the application material is flowed out of the filling area through the passage portion. In other words, when the extruding portion is assembled in the filling member, the extruding portion is inward inserted to the filling member while securely discharging the air between the application material and the extruding portion out of the filling area via the passage portion, for example, until the application material is flowed out of the filling area via the passage portion. Therefore, it is possible to more securely inhibit the air from standing between the application material and the extruding portion. As a result, it is possible to prevent the application material from leaking out of the discharge port by itself due to the temperature change or the like. For example, it is possible to make the application material flowed out of the passage portion serve as a lubricating material for a sliding portion (for example, a threaded portion) within the container.

Further, it is preferable that a wall portion is further provided within the container, and the wall portion covers an opening in an outer side of the filling area in an opposed side to the filling area side in the passage portion so that a part of the application material flowed out of the passage portion is guided rearward. In this case, it is possible to positively make a part of the application material flowed out of the passage portion serve as the lubricating material for the sliding portion or the like which is arranged in the rear side within the container.

Further, there is a case that the passage portion includes a hole portion which passes through inner and outer sides of the filling member. Further, there is a case that the passage portion in dudes a groove portion which is formed in an inner surface of the filling member and extends so as to be open to the rear end of the filling member.

Further, it is preferable that at least a part of the extruding portion is arranged in front of the rear end of the opening closer to the filling area in the passage portion, in a state in which the extruding portion is positioned at a backward moving limit. In this case, when the extruding portion is assembled in the filling member, it is possible to further securely discharge the air between the application material and the extruding portion out of the filling area via the passage portion.

Further, it is preferable that a front end of an area coming into close contact with the filling member in the extruding portion is arranged forward beyond the opening closer to the filling area in the passage portion, in a state in which the extruding portion is positioned at the backward moving limit. Accordingly, it is possible to securely prevent the filling area and the passage portion from being communicated with each other, and it is possible to secure an airtightness of the filling area.

At this time, there is a case that the application material has a volatile. In this case, the effect of securing the airtightness of the filling area is particularly effective since a volatilization of the application material can be preferably suppressed.

DETAILED DESCRIPTION OF PREFERRED EMBODIMENT

Figure 1:
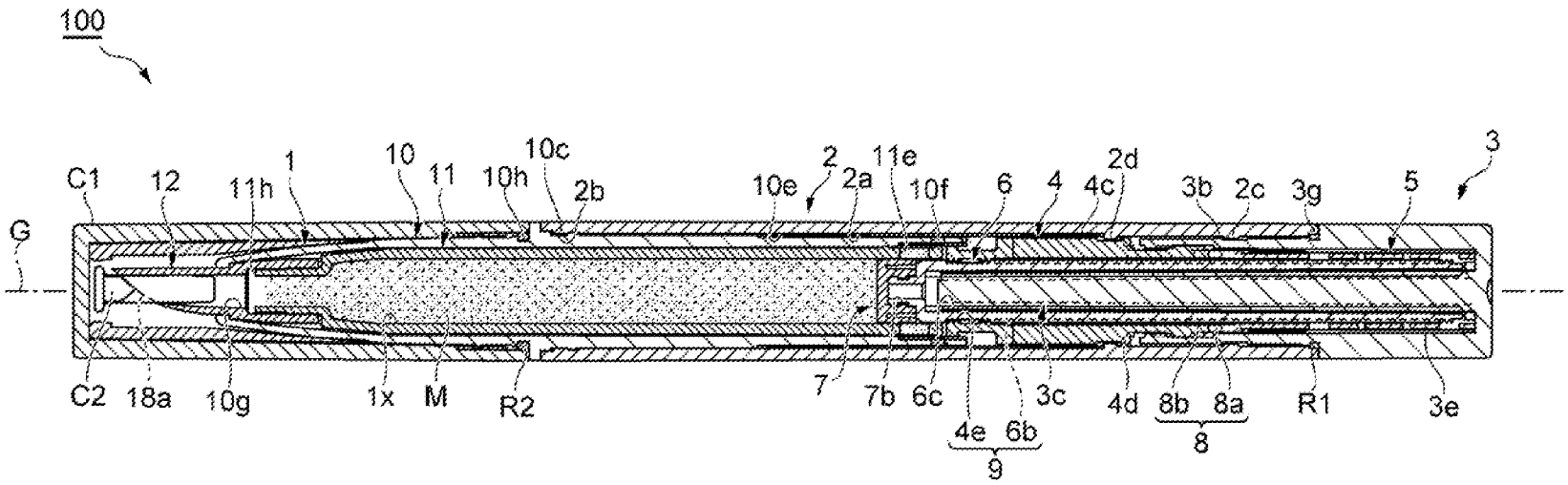
FIG. 1 is a vertical cross sectional view showing an initial state of an application material extruding container according to an embodiment of the present invention.

A description will be in detail given below of a preferable embodiment according to the present invention with reference to the accompanying drawings. In the following description, the same reference numerals are attached to the same or corresponding elements, and an overlapping description will be omitted.

Figure 2:
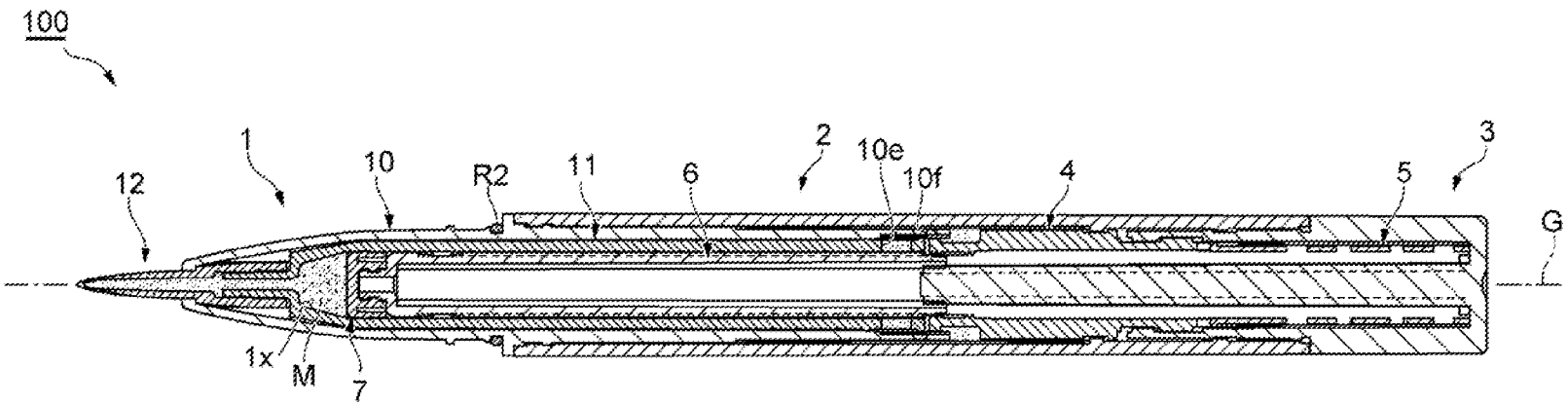
FIG. 2 is a vertical cross sectional view showing a state in which a moving body is at a forward limit in the application material extruding container in FIG. 1, at a position which is 90 degrees different from a position of the vertical cross section in FIG. 1.
Figure 3:
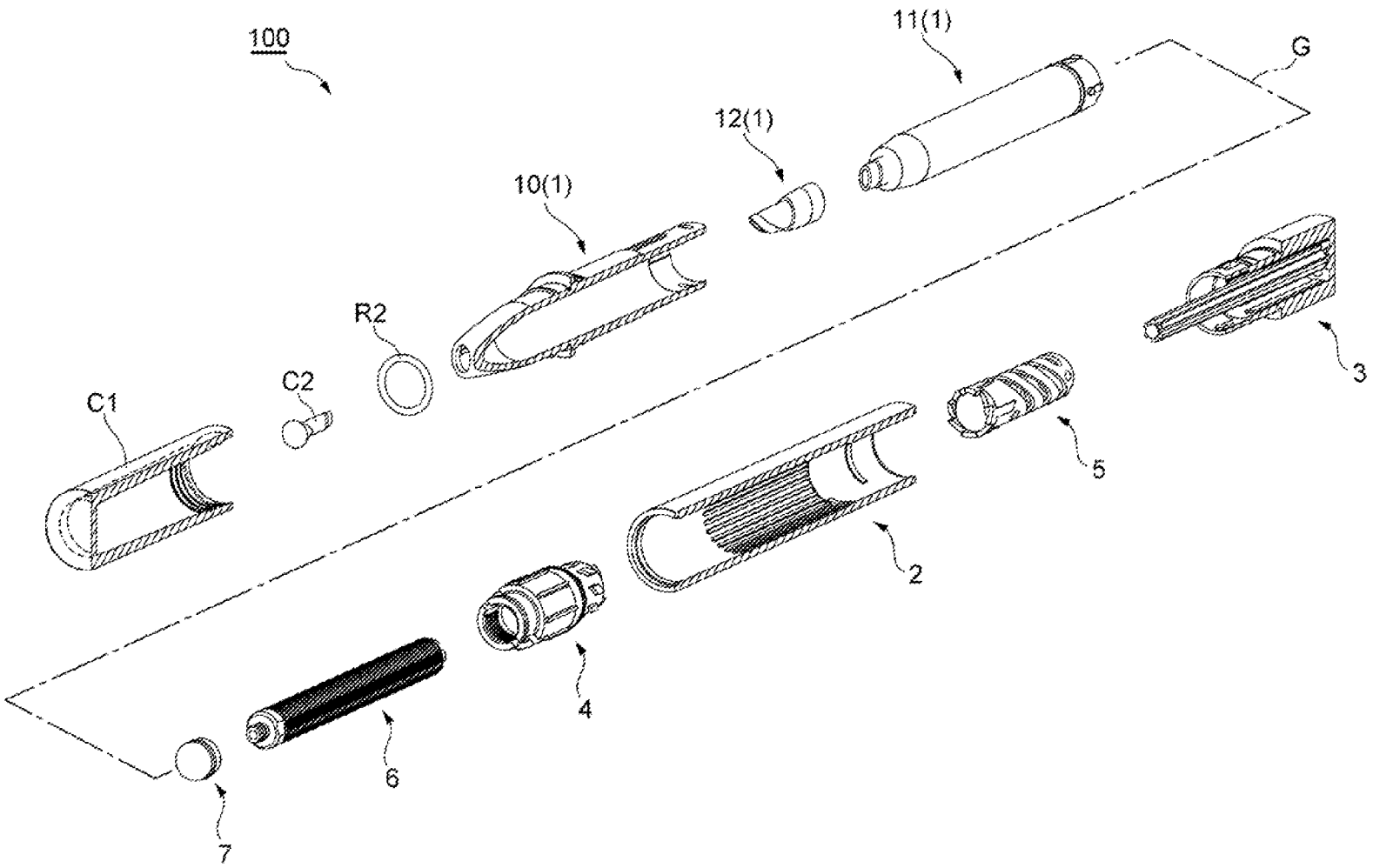
FIG. 3 is an exploded perspective view showing the application material extruding container in FIG. 1 while partially using a cross section.
Figure 4:
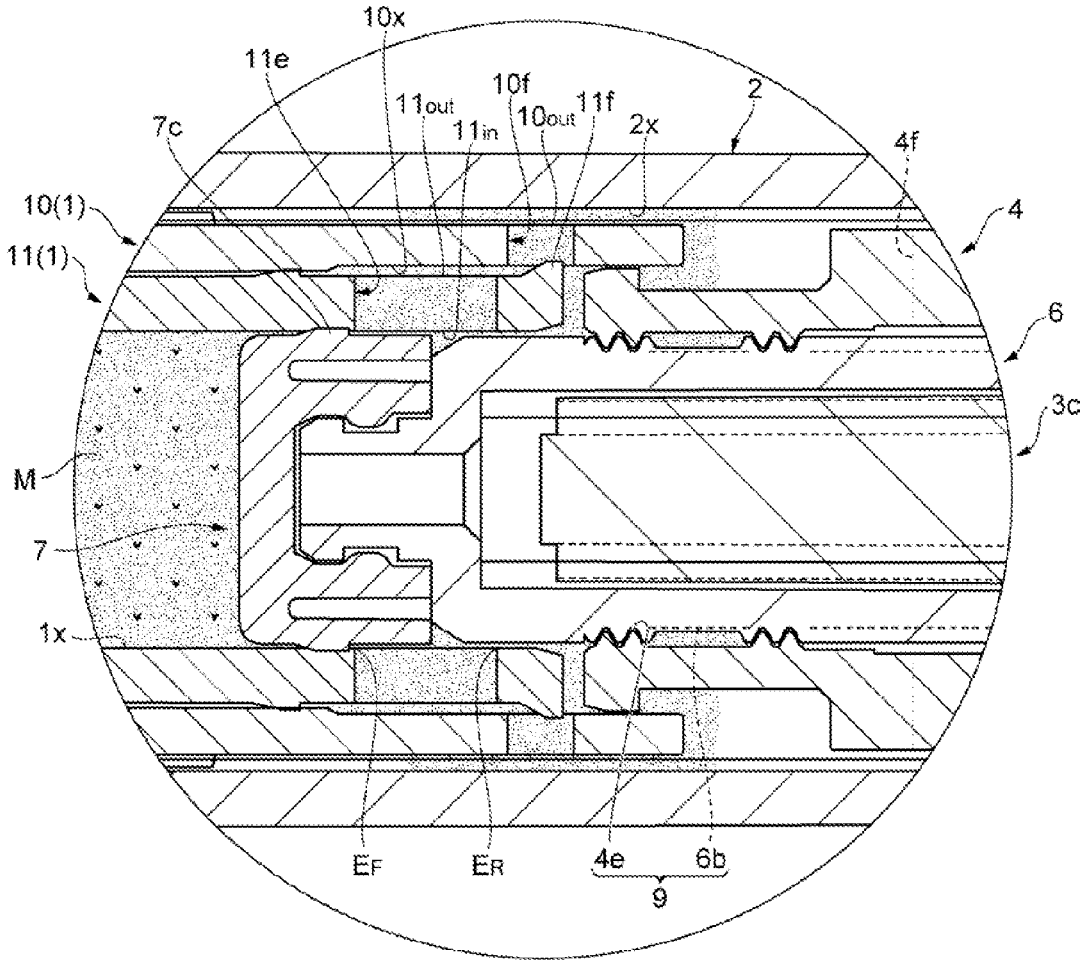
FIG. 4 is a cross sectional view showing a substantial part in the application material extruding container in FIG. 1 in an enlarged manner.

FIG. 1 is a vertical cross sectional view showing an initial state of an application material extruding container according to an embodiment of the present invention, FIG. 2 is a vertical cross sectional view showing a state in which a moving body is at a forward limit in the application material extruding container, FIG. 3 is an exploded perspective view showing the application material extruding container while partially using a cross section, and FIG. 4 is a cross sectional view showing a substantial part in the application material extruding container in FIG. 1 in an enlarged manner. In FIG. 2, there is shown the vertical cross sectional view at a position which is 90 degrees different from a position of the vertical cross section in FIG. 1. As shown in FIGS. 1 to 3, an application material extruding container 100 according to the present embodiment is structured such that an application material M filled in an internal portion is appropriately discharged (extruded) on the basis of an operation of a user.

The application material M can employ various materials in a jelly state, a gel state, a paste state, a soft state, a moose state, a sludge state, a semisolid state, a soft solid state and a solid state, for example, an eye liner, an eye color, an eye shadow, an eyebrow, a lip gross, a lip stick, a lip liner, a cheek color, an essence, a beauty stick, a cleaning fluid, a cleansing oil, a nail enamel, a nail care liquid solution, a nail remover, a mascara, an anti-aging, a hair color, a hair application material, an oral care, a massage oil, a keratotic plug remover, a foundation, a concealer, a skin cream, an ink for a writing instrument such as a marking pen, a drug medicine and the like. Further, by blending a volatile solvent (for example, a silicone oil such as a cyclopentasiloxane, or a hydrocarbon oil such as an isododecane and an isohexadecane) in the application material M, in addition to a pigment, an oil solution and a wax, a long time lasting property can be enhanced. As an example which is preferable for the application material M, there can be employed a makeup cosmetic material, for example, a gel state eye liner, which is blended with a volatilization component (a volatile solvent) and has a high long lasting property.

Further, as the application material M, it is preferable to employ a material in a gel state or a semisolid state which is high in a viscosity or a hardness, and is high in a compressibility, and the application material M having a hardness between about 0.1 N and about 0.3 N can be particularly preferably employed. The hardness of the application material M is determined according to a general measuring method which is used for measuring a hardness in a cosmetic material. Here, a hardness (a penetration) is defined by a peak force (a strength) which is generated in the application material M, for example, in the case of using FUDOH RHEO METER [RTC-2002D.D] (manufactured by RHEOTECH), and inserting a steel rod (an adapter) having a diameter $\phi$3 mm at about 10 mm to the application material M at a speed of 6 cm/min under a condition of an atmospheric temperature 25° C.

The application material extruding container 100 is provided with a filling member 1 corresponding to a leading tube having in its inner portion a filling area 1*x* in which the application material M is filled, a main body tube 2 inward inserting a rear half portion of the filling member 1 to a front half portion thereof so as to engage the filling member 1 in an axial direction (back and forth direction) and a rotating direction around an axis (hereinafter, refer simply to as "rotating direction") and integrally couple the filling member 1, and a control tube 3 coupled to a rear end portion of the main body tube 2 in an axial direction so as to be relatively rotatable, as an outer structure. Here, the filling member 1 and the main body tube 2 construct a front portion of the container, and the control tube 3 constructs a rear portion of the container. Further, the term "axis" means a center line G which extends back and forth in the application material extruding container 100, and the term "axial direction" means a direction which is along the axis (and so forth). Further, a feeding direction of the application material M in a side of a pen tip member 12 mentioned later in the axial direction is assumed to be a forward side (a forward moving direction), and a feedback direction of the application material M in a side of the control tube 3 in the axial direction is assumed to be a backward side (a backward moving direction).

Further, the application material extruding container 100 is approximately provided in an inner portion thereof with a moving body 6 which moves in the axial direction on the basis of a relative rotation of the main body tube 2 (or the filling member 1) and the control tube 3, a piston 7 which is installed to a front end (a leading end) of the moving body 6, is inward inserted to the filling member 1 so as to come into close contact with the filling member 1 and serves as an extruding portion constructing (forming) a rear end of the filling area 1*x*, a thread tube 4 which serves as a threaded member allowing movement of the moving body 6 on the basis of the relative rotation, and a ratchet member 5 which can relatively rotate only in one direction in relation to the threaded tube 4.

Further, the application material extruding container 100 is provided with a ratchet mechanism 8 which allows a relative rotation of the main body tube 2 and the control tube 3 only in one direction, and a cam mechanism 20 which moves the moving body 6 and the piston 7 forward and backward within a fixed stroke per a fixed rotating amount of relative rotation between the main body tube 2 and the control tube 3. The cam mechanism 20 here is a cylinder cam mechanism including a protruding portion 20*a* and a guide portion 20*b*, and moves the moving body 6 and the piston 7 forward and backward at a fixed stroke on the basis of the rotating force of the relative rotation between the main body tube 2 and the control tube 3.

The main body tube 2 is constructed as a cylindrical shape, and has on an inner peripheral surface of a center portion in an axial direction, knurls 2*a* which are provided side by side with a lot of concavo-convex portions in a peripheral direction and are structured such that the concave-convex portions extend at a predetermined length in the axial direction, for engaging the filling member 1 and the threaded tube 4 in the rotating direction. Further, an inner peripheral surface of a leading end portion of the main body tube 2 is provided with an annular protruding portion 2*b* for engaging the filling member 1 in the axial direction. A protruding portion 2*c* extending in a peripheral direction is formed in an inner peripheral surface in a rear side of the main body tube 2 for engaging the control tube 3 in the axial direction.

Further, a protruding portion 2*d* extending along the peripheral direction is formed in a front side of the protruding portion 2*c* in the inner peripheral surface of the main body tube 2 for engaging the threaded tube 4 in the axial direction. Further, as shown in FIG. 4, the inner peripheral surface of the main body tube 2 constructs a wall portion (a second wall portion) 2*x* which covers an opening $\mathbf{10}_{out}$ in an opposite side (an outer side of the filling area 1*x*) to the filling area 1*x* side in a hole portion 10*f* of an outer filling tube 10 mentioned later with a gap. The wall portion 2*x* has a function of rearward guiding a part of the application material M flowing out of the hole portion 10*f*.

Figure 5:
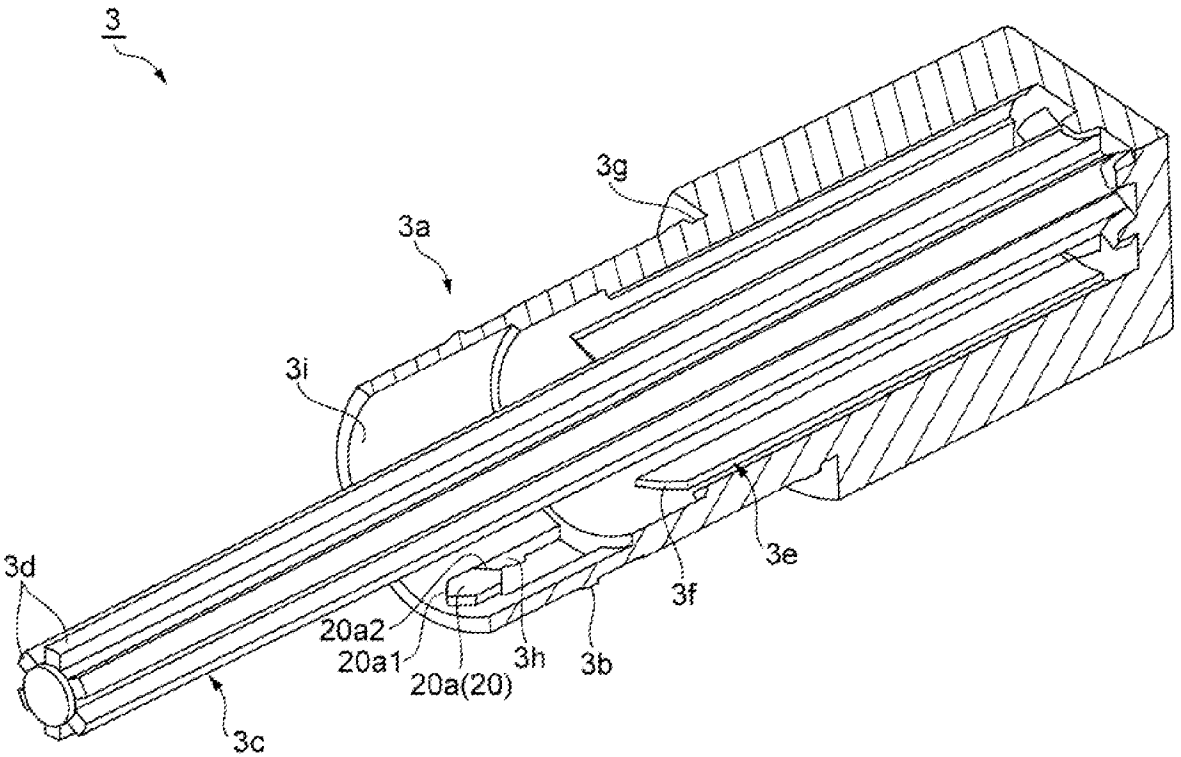
FIG. 5 is a perspective view showing a control tube of the application material extruding container in FIG. 1 while partially using a cross section.
Figure 6:
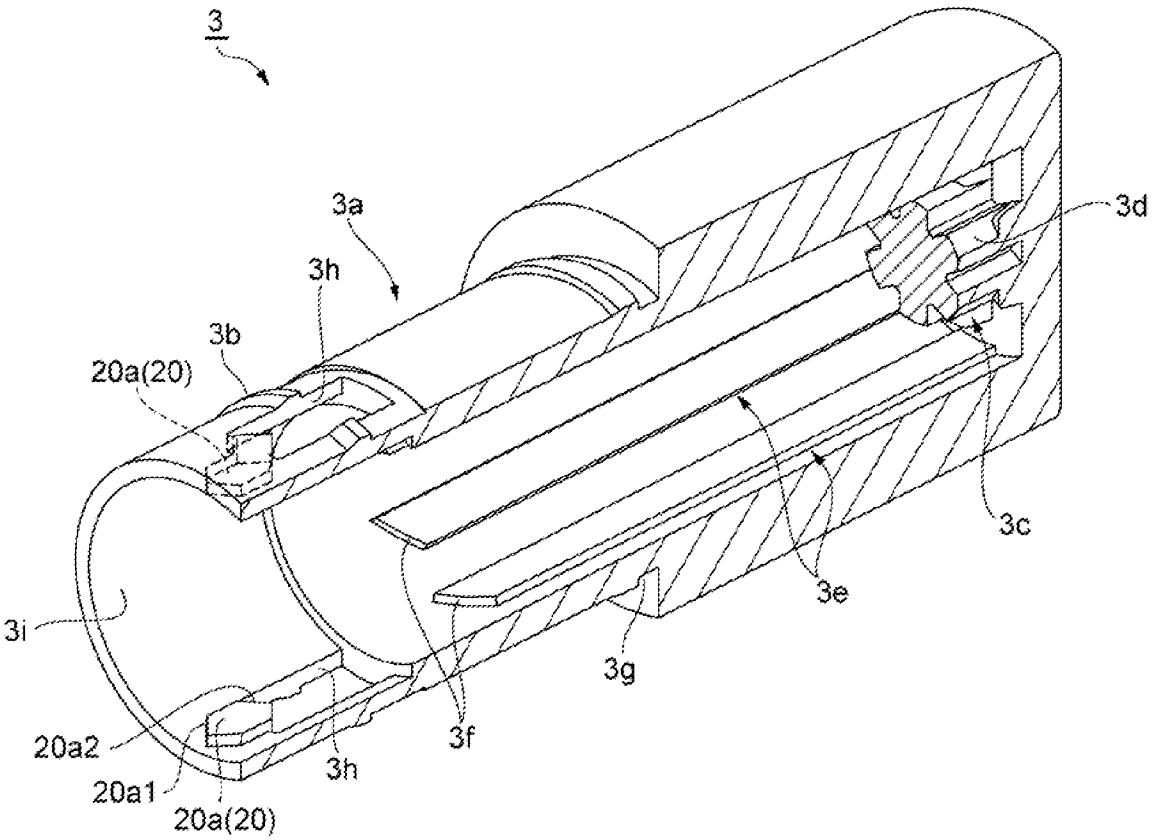
FIG. 6 is the other perspective view showing the control tube of the application material extruding container in FIG. 1 while partially using a cross section.

FIGS. 5 and 6 are perspective views showing a part of the control tube by partially using a cross section. As shown in FIGS. 5 and 6, the control tube 3 is formed as an injection molded product by a resin, and is formed as a closed-end cylindrical shape which is open forward. The control tube 3 is provided in its front end side with a front end tube portion 3*a* which has a small outer diameter, and an outer peripheral surface of the front end tube portion 3*a* is provided with an annular groove portion 3*b* for engaging with the protruding portion 2*c* of the main body tube 2 in the axial direction. Further, a shaft body 3*c* is provided in a rising manner in the center of a bottom portion of the control tube 3. The shaft body 3*c* is formed as a noncircular shape in a transverse cross section (a cross section which is orthogonal to the axial direction) having a plurality of protruding ridges 3*d* extending in the axial direction on an outer peripheral surface of a columnar body, and the protruding ridges 3*d* construct one of a rotation preventing portion of the moving body 6.

Further, the control tube 3 is provided in an inner peripheral surface with protruding ridges 3*e* which extend from the bottom portion toward a leading end side, at eight uniformly arranged positions in a peripheral direction. A leading end surface 3*f* of the protruding ridge 3*e* is inclined in relation to a transverse cross section corresponding to an orthogonal surface in the axial direction (hereinafter, refer simply to as "transverse cross section"). Specifically, the leading surface 3*f* is inclined rearward toward one side in the peripheral direction in a diametrical direction view. In other words, the leading end surface 3*f* is inclined rearward toward a relative rotating direction which is allowed by the ratchet mechanism 8 (hereinafter, refer to as "allowed rotating direction"), and is formed appropriately in parallel to a rear end surface 5*f* of a vertical rib 5*e* mentioned later.

Further, an O-ring groove 3*g* extending annularly is provided in a rear end on an outer peripheral surface of the front end tube portion 3*a* of the control tube 3 for installing an O-ring R1. The O-ring R1 is provided for applying an appropriate rotary resistance at a time of the relative rotation between the main body tube 2 and the control tube 3, and serves as an annular elastic body which generates a predetermined rotary resistance force in the relative rotation.

Further, the control tube 3 has a pair of (a plurality of) protruding portions 20*a* constructing one of the cam mechanism 20, in a front end portion on an inner peripheral surface thereof. The protruding portion 20*a* is guided by the guide portion 20*b* while relatively sliding with the guide portion 20*b*. Accordingly, the protruding portion 20*a* serves as a driver for transmitting a rotating force at a time when a user relatively rotates the main body tube 2 and the control tube 3 to the guide portion 20*b* on the basis of a sliding operation.

The protruding portions 20*a* are provided at two uniformly arranged positions in the peripheral direction and protrude at a predetermined length to an inner side in the diametrical direction. Specifically, an area from the center of the front end tube portion 3*a* to the front end is expanded in the inner peripheral surface of the control tube 3 so as to be formed as a large-diameter inner peripheral surface 3*i*, and a pair of protruding portions 20*a* having a fixed height are formed so as to be opposed to a front end of the large-diameter inner peripheral surface 3*i* with each other. Further, a hole portion 3*h* penetrating in a diametrical direction is formed in an area which is connected to the rear side of the protruding portion 20*a* in the large-diameter inner peripheral surface 3*i*, for forming the protruding portion 20*a*. The hole portion 3*h* is formed as a rectangular shape having an equal width in the peripheral direction to the protruding portion 20*a* as seen from a diametrical direction.

As shown in FIGS. 1 and 5, the control tube 3 is inward inserted to the main body tube 2 from the front end tube portion 3*a*, and the annular groove portion 3*b* engages with the protruding portion 2*c* of the main body tube 2, thereby being coupled and installed to the main body tube 2 in the axial direction so as to be relatively rotatable. At this time, the O-ring R1 is fitted to the O-ring groove 3*g* of the control tube 3, whereby an appropriate rotary resistance is applied to the relative rotation between the main body tube 2 and the control tube 3. There is a case that the O-ring R1 (and the O-ring groove 3*g*) are not provided for reducing a production cost.

The control tube 3 mentioned above can be resin molded by using a metal mold or a core pin. Since the control tube 3 has a hole portion 3*h*, the protruding portion 20*a* can be preferably formed by utilizing a convex portion for forming the hole portion 3*h* in the metal mold. For example, when a slide core and a core pin in the metal mold are assembled with each other, a predetermined space corresponding to the protruding portion 20*a* can be defined in such a manner as to be pinched in a vertical direction to the axial direction, by a convex portion of the slide core and the core pin. As a result, when the core pin is detached after the molding (that is, after a molten resin is filled and solidified in the predetermined space and the protruding portion 20*a* is formed), an undercut portion formed in a rear side of the protruding portion 20*a* is released by sliding the convex portion of the slide core in the vertical direction to the axis, whereby the core pin can be easily drawn out in the axial direction.

Figure 7:
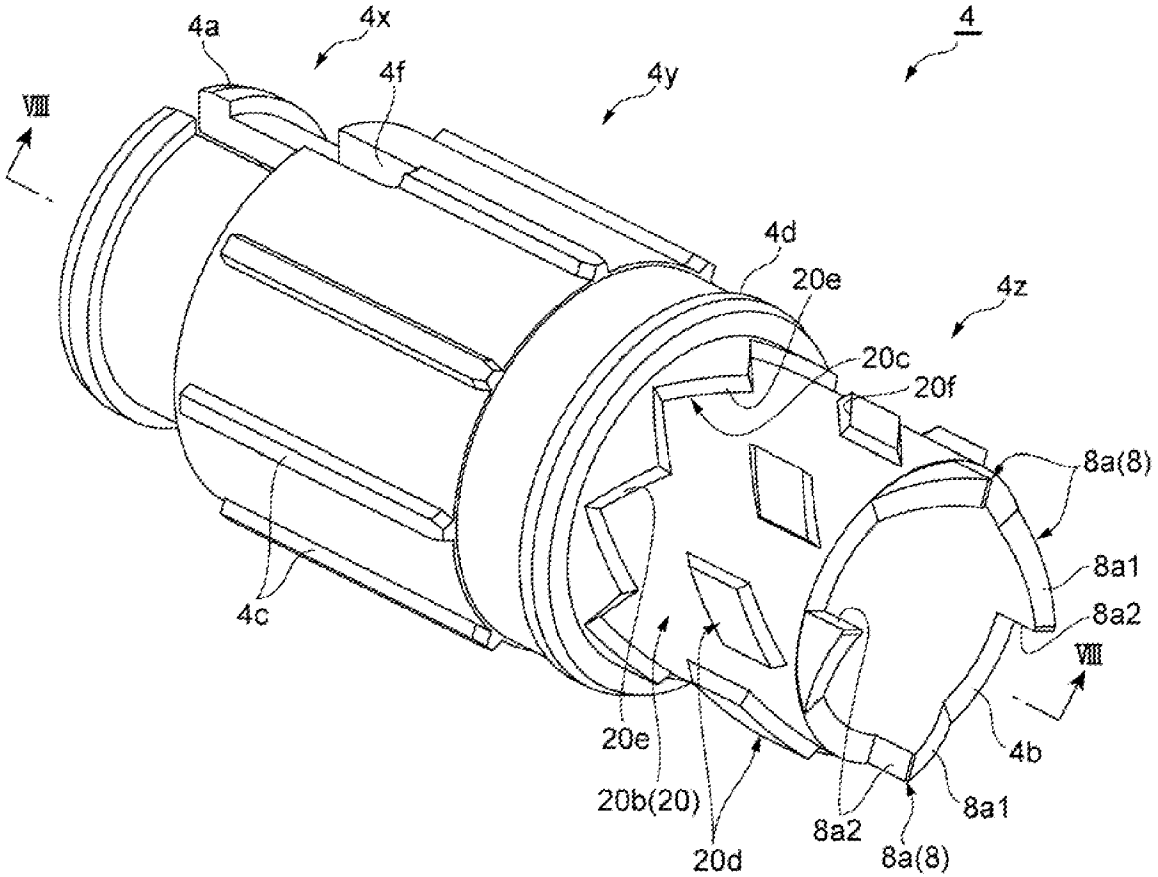
FIG. 7 is a perspective view showing a threaded tube of the application material extruding container in FIG. 1.
Figure 8:
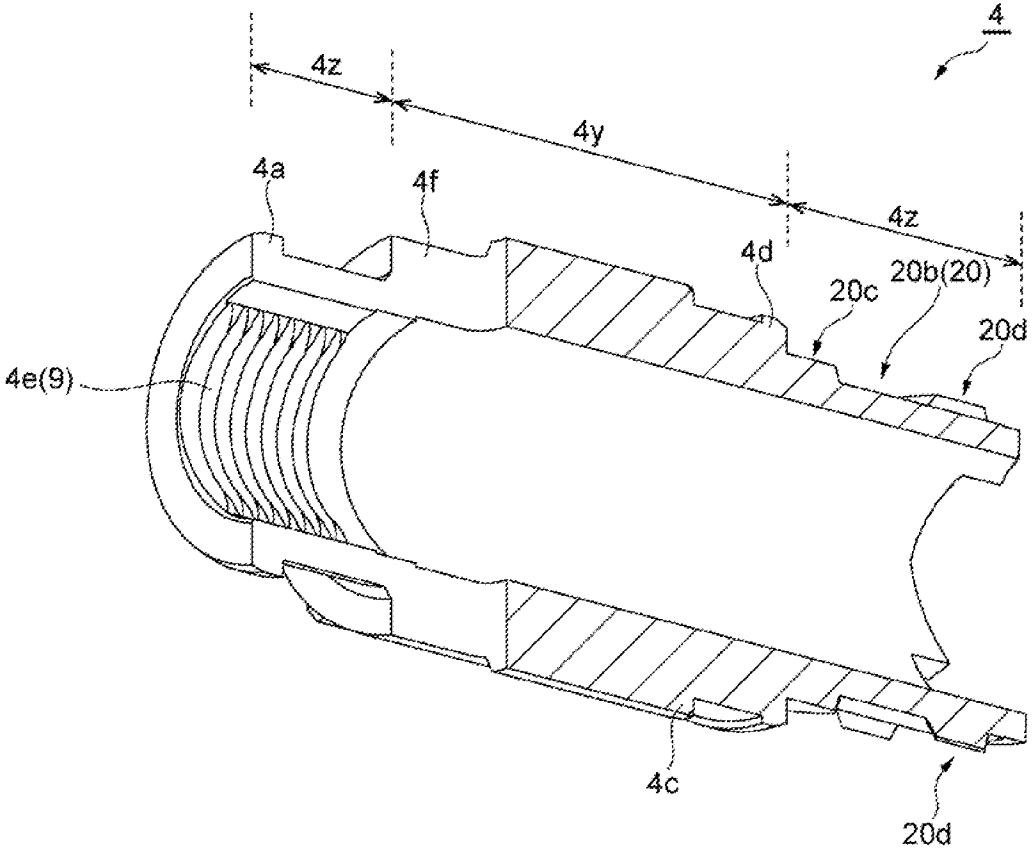
FIG. 8 is a cross sectional view along a line VIII-VIII in FIG. 7.

FIG. 7 is a perspective view showing the threaded tube, and FIG. 8 is a cross sectional view along a line VIII-VIII in FIG. 7. As shown in FIGS. 7 and 8, the threaded tube 4 is formed as an injection molded product by the resin, and is formed as a stepped cylindrical outer shape. The threaded tube 4 has a front end tube portion 4*x*, a center tube portion 4*y* which has an outer shape with larger diameter than the front end tube portion 4*x*, and a rear end tube portion 4*z* which has an outer shape with smaller diameter than the center tube portion 4*y* in this order from a front side to a rear side. On the other hand, an inner peripheral surface of the threaded tube 4 extends straight along the axial direction with no step.

The front end tube portion 4*x* constructs a front end portion of the threaded tube 4, and is provided in an inner peripheral surface with a female thread 4*e* which constructs one of the threaded portion (the extruding mechanism) 9. A pitch of the threaded portion 9 here employs a narrow pitch, and is set, for example, to 0.5 mm. A front end portion on an outer peripheral surface of the front end tube portion 4*x* is provided with a collar portion 4*a* for preventing an inner diameter of the female thread 4*e* from being expanded so as to be in close contact with the filling member 1 (refer to FIG. 1).

The center tube portion 4*y* constructs the center portion of the threaded tube 4 and the front end side of the center portion, and protruding ridges 4*c* for engaging with the knurl 2*a* of the main body tube 2 in the rotating direction are formed at a plurality of positions in a peripheral direction on an outer peripheral surface thereof. Further, an annular convex portion 4*d* for engaging with the protruding portion 2*d* of the main body tube 2 in the axial direction is formed on an outer peripheral surface of a rear end portion of the center tube portion 4*y*. Further, a pair of slits 4*f* penetrating in the diametrical direction and extending at a predetermined length in the axial direction are formed in the front end tube portion 4*x* and the front end portion of the center tube portion 4*y* so as to be opposed.

The rear end tube portion 4*z* constructs a rear end portion and a rear end side of the center portion of the threaded tube 4, and a plurality of ratchet teeth 8*a* engaging with the ratchet member 5 are provided in the rear end surface 4*b* along a peripheral direction, so as to construct the ratchet mechanism 8. The ratchet teeth 8*a* here are provided in a protruding manner at four uniformly arranged positions in the peripheral direction on the rear end surface 4*b*.

The ratchet teeth 8*a* protrude out of the rear end surface 4*b* while forming a saw-tooth shape (a wedge shape) along the peripheral direction. Specifically, a side surface 8*a*1 in the other side (a contact side with the ratchet teeth 8*a* at a time of relatively rotating the main body tube 2 and the control tube 3 in one direction) in the peripheral direction in the ratchet teeth 8*a* is inclined in relation to the rear end surface 4*b* so as to form a chevron form in the peripheral direction. On the other hand, a side surface 8*a*2 in one side (a contact side with the ratchet teeth 8*a* at a time of relatively rotating the main body tube 2 and the control tube 3 in the other direction) in the peripheral direction in the ratchet teeth 8*b* extends along the axial direction while being orthogonal to the rear end surface 4*b*.

Further, the rear end tube portion 4*z* has the guide portion 20*b* which constructs the other of the cam mechanism 20. The guide portion 20*b* guides a sliding motion of the protruding portion 20*a* while relatively sliding the protruding portion 20*a* of the control tube 3. The guide portion 20*b* serves as a follower to which the rotating force of the main body tube 2 and the control tube 3 is transmitted as a linear moving force in the back and forth direction on the basis of the sliding motion from the protruding portion 20*a*. A front side of the guide portion 20*b* is defined by a bulge portion 20*c* which bulges in relation to an outer peripheral surface of the rear end tube portion 4*z*, and a rear side of the guide portion 20*b* is defined by a plurality of guide pieces 20*d* serving as projections which protrude in relation to the outer peripheral surface of the rear end tube portion 4*z*.

The bulge portion 20*c* is provided in a front end portion of the rear end tube portion 4*z* in such a manner as to bulge at a predetermined length to an outer side in a diametrical direction. A rear surface of the bulge portion 20*c* is formed as a saw-tooth shape (a wedge shape) along the peripheral direction. Further, a rear surface of the bulge portion 20*c* is constructed while including a guide surface 20*e* which is inclined (intersects) in relation to the transverse cross section, as a sliding element with the protruding portion 20*a*.

A plurality of guide pieces 20*d* are provided in a rear end portion of the rear end tube portion 4*z* so as to protrude at a predetermined length to an outer side in the diametrical direction. The guide pieces 20*d* are arranged so as to be spaced only at a distance corresponding to the fixed stroke, in a rear side of the bulge portion 20*c*. Further, a plurality of guide pieces 20*d* are arranged side by side along the peripheral direction so as to be spaced at a wider gap than a peripheral width of the protruding portion 20*a*. The guide pieces 20*d* here are provided at eight uniformly arranged positions in the peripheral direction.

As shown in FIGS. 1 and 7, the threaded tube 4 is inward inserted to the main body tube 2, the annular convex portion 4*d* engages with the protruding portion 2*d* of the main body tube 2 so as to be movable in the axial direction, and the protruding ridge 4*c* engages with the knurl 2*a* of the main body tube 2 in the rotating direction. Further, the threaded tube 4 is inward inserted its rear end tube portion 4*z* into the control tube 3. Accordingly, the threaded tube 4 is engaged with the main body tube 2 in the rotating direction, is installed to the main body tube 2 so as to be synchronously rotatable, and is movable in the axial direction between the protruding portion 2*d* of the main body tube 2 and the front end surface of the control tube 3. At this time, the protruding portion 20*a* of the control tube 3 is moved forward along the axial direction from a gap D between a plurality of guide pieces 20*d* in the guide portion 20*b* into the guide portion 20*b*, whereby the protruding portion 20*a* is assembled in the guide portion 20*b* and the cam mechanism 20 is formed.

The threaded tube 4 mentioned above can be resin molded by using the slide core and the core pin of the metal mold. Here, a four-direction slide core type metal mold which can be separated into four pieces in a peripheral direction is used. Accordingly, it is possible to form an undercut shape of the guide pieces which are provided at eight uniformly arranged positions in the peripheral direction with an unforced manner.

Figure 9:
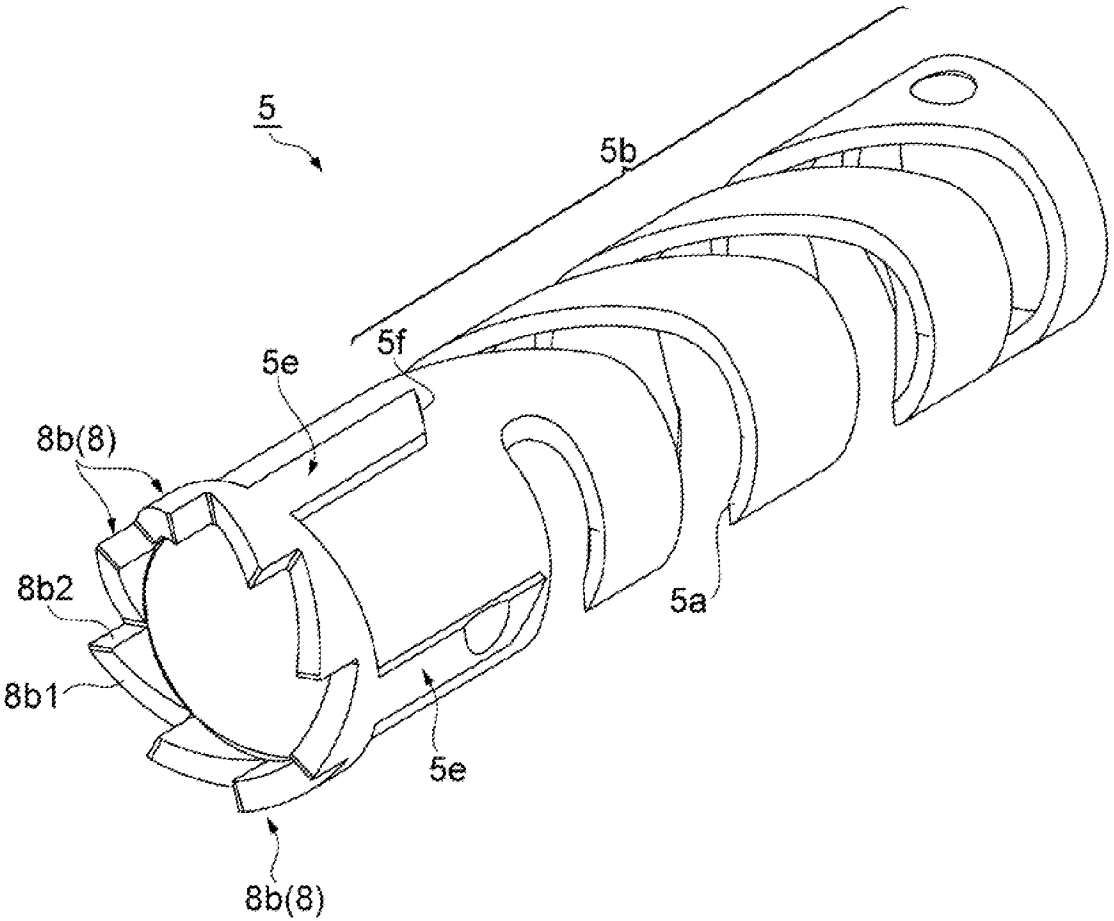
FIG. 9 is a perspective view showing a latchet member of the application material extruding container in FIG. 1.
Figure 10:
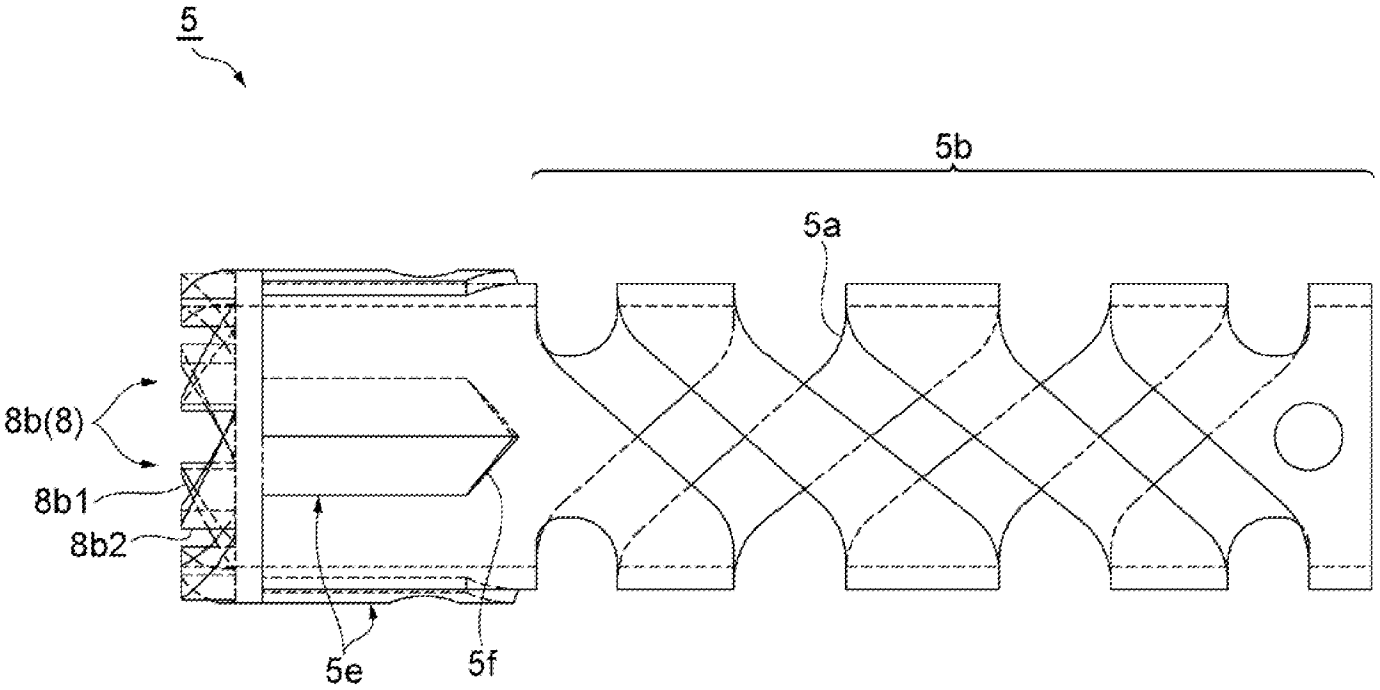
FIG. 10 is a plan view showing the latchet member of the application material extruding container in FIG. 1.

FIG. 9 is a perspective view showing the ratchet member, and FIG. 10 is a plan view showing the ratchet member. As shown in FIGS. 9 and 10, the ratchet member 5 is formed as an injection molded product by a resin, and is constructed approximately as a cylindrical shape. A front end surface of the ratchet member 5 is provided with a plurality of ratchet teeth 8*b* engaging with the ratchet teeth 8*a* of the threaded tube 4 along a peripheral direction, as an element constructing the ratchet mechanism 8. The ratchet teeth 8*b* here are provided in a protruding manner at eight uniformly arranged positions in the peripheral direction in the front end surface of the ratchet member 5.

The ratchet teeth 8*b* protrude out of the front end surface while forming the saw-tooth shape (the wedge shape) along the peripheral direction. Specifically, a side surface 8*b*1 in one side (a contact side with the side surface 8*a*1 of the ratchet teeth 8*a* at a time of relatively rotating the main body tube 2 and the control tube 3 in one direction) in the peripheral direction in the ratchet teeth 8*b* is inclined in relation to the front end surface so as to form a chevron form in the peripheral direction. On the other hand, a side surface 8*b*2 in the other side (a contact side with the side surface 8*a*2 of the ratchet teeth 8*a* at a time of relatively rotating the main body tube 2 and the control tube 3 in the other direction) in the peripheral direction in the ratchet teeth 8*b* extends along the axial direction while being orthogonal to the front end surface.

An approximately spiral slit 5*a* is formed in a portion from a center portion to a rear end in a peripheral wall of the ratchet member 5. Accordingly, the ratchet member 5 serves as a spring portion 5*b* which energizes the ratchet teeth 8*b* toward a forward direction corresponding to the ratchet teeth 8*a* side. Further, vertical ribs 5*e* extending in an axial direction while having a predetermined width in the peripheral direction are provided in a front end portion of an outer peripheral surface of the ratchet member 5 for engaging with the protruding ridge 3*e* of the control tube 3 in a rotating direction.

The vertical ribs 5*e* are provided at eight uniformly arranged positions in the peripheral direction in the front end portion of the outer peripheral surface of the ratchet member 5. A rear end surface 5*f* of the vertical rib 5*e* is inclined forward in relation to the transverse cross section toward the other side in the peripheral direction in a diametrical view. In other words, the rear end surface 5*f* is inclined forward toward an allowable rotating direction of the ratchet member 5, and is approximately in parallel to the leading end surface 3*f* of the protruding ridge 3*e* of the control tube 3.

As shown in FIGS. 1 and 9, the ratchet member 5 is inward inserted to the control tube 3 from a rear side thereof, the vertical rib 5*e* thereof moves forward into a portion between the protruding ridges 3*e* and 3*e* of the control tube 3, and the vertical rib 5*e* is engaged with the protruding ridge 3*e* in the rotating direction. In conjunction with this, the ratchet member 5 is brought into contact with the rear end side of the threaded tube 4, and the ratchet teeth 8*b* can be engaged with the ratchet teeth 8*a* of the threaded tube 4. Accordingly, the ratchet member 5 is assembled in the control tube 3 in a state in which a relative rotation is controlled so that the ratchet member 5 can relatively rotate only in the allowable rotating direction in relation to the threaded tube 4 by the ratchet teeth 8*a* and 8*b*.

Further, the ratchet member 5 is pinched in the axial direction by the rear end side of the threaded tube 4 and the bottom surface of the control tube 3, and an energizing force (an elastic force) is generated by the spring portion 5*b*, whereby the ratchet teeth 8*b* are energized in a forward side. Accordingly, the ratchet teeth 8*a* and 8*b* engaging with each other are set to a clock engaged state.

When the vertical ribs 5*e* are moved forward between the protruding ridges 3*e* and 3*e* for engaging with the protruding ridges 3*e* in the rotating direction, the positions thereof in the rotating direction may be deviated from each other, and the rear end surfaces 5*f* of the vertical ribs 5*e* and the leading end surfaces 3*f* of the protruding ridges 3*e* may be brought into contact with each other. In this case, since the rear end surfaces 5*f* and the leading end surfaces 3*f* are formed as the inclined surfaces mentioned above, the relative rotation of the ratchet member 5 in the allowable rotating direction is promoted, and the relative rotation of the ratchet member 5 in the opposite side to the allowable rotating direction is controlled. Accordingly, in this case, the ratchet member 5 is relatively rotated in the allowable rotating direction, and the vertical ribs 5*e* move forward between the protruding ridges 3*e* and 3*e* while being moved in the allowable rotating direction in relation to the protruding ridges 3*e*. As a result, it is possible to inhibit the ratchet member 5 from being forcibly rotated relatively in the opposite side to the allowable rotating direction for engaging the vertical ribs 5*e* with the protruding ridges 3*e*. Further, it is possible to inhibit the ratchet teeth 8*a* and 8*b* and the other rotary engaging portions from being broken for the forcible relative rotation.

Turning back to FIG. 1, the moving body 6 is constructed as a cylindrical shape, and is provided with a male thread 6*b* which constructs the other of the threaded portion 9, on an outer peripheral surface from a rear side of its front end portion toward a rear end portion. Further, protruding ridges 6*c* protruding to an inner side in a diametrical direction and extending in an axial direction are provided at six uniformly arranged positions in a peripheral direction on an inner peripheral surface of the moving body 6, for constructing the other of the rotation preventing portion of the moving body 6. The moving body 6 is outward inserted to the shaft body 3*c* of the control tube 3 and is inward inserted to the threaded tube 4, and the male thread 6*b* thereof is threadably engaged with the female thread 4*e* of the threaded tube 4. In conjunction with this, the moving body 6 is engaged with and installed to the control tube 3 in the rotating direction so as to be movable in the axial direction, in a state in which the protruding ridges 6*c* thereof engage between the protruding ridges 3*d* and 3*d* (refer to FIG. 5) of the shaft body 3*c*.

The piston 7 is formed by a polyester elastomer (TPEE), a polyurethane elastomer (TPU), a polypropylene (PP), a high density polyethylene (HDPE) or a linear low density polyethylene (LLDPE), which has a different color tone (for example, a white color) from a color tone of the application material M. The piston 7 is formed as an approximately cylindrical shape in its outer shape, is formed as a flat surface shape which is orthogonal in an axial direction in its front end surface, and is provided in a depressing manner with a concave portion in its rear end surface. In other words, the piston 7 has a horseshoe shape which is formed flat in its front surface, and is open rearward in a vertical cross sectional view. An inner peripheral surface of the concave portion is provided with an annular protruding portion 7*b* which engages with the moving body 6 so as to be movable at a predetermined length in the axial direction.

Further, an outer peripheral surface of the piston 7 is provided with a convex portion 7*c* which comes into contact (close contact) with the filling member 1 so as to make the filling area 1*x* airtight, as an area which is closely attached to the filling member 1, as shown in FIG. 4. The piston 7 as mentioned above is outward inserted to a front end portion of the moving body 6, and the annular protruding portion 7*b* engages with the moving body 6 in the axial direction, thereby being installed to the moving body 6 so as to be movable in the axial direction (movable within a predetermined range).

Figure 11:
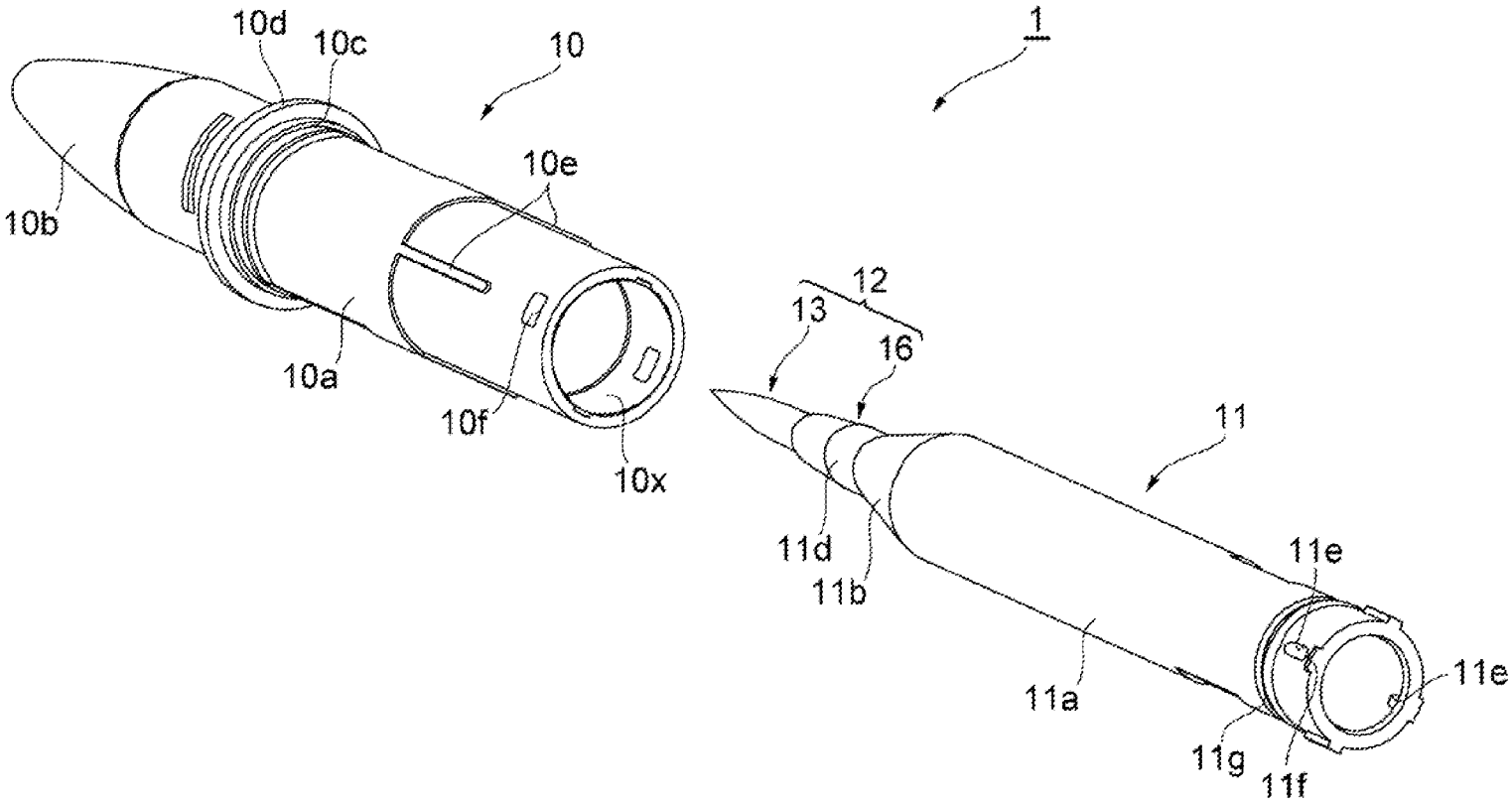
FIG. 11 is an exploded perspective view showing a filling member of the application material extruding container in FIG. 1.

FIG. 11 is an exploded perspective view showing the filling member. As shown in FIGS. 1 and 11, the filling member 1 is formed by an injection molding plastic, for example, a polyethylene terephthalate (PET), a polybutylene terephthalate (PBT), a polycyclohexane dimethylene terephthalate (PCTA) or a polypropylene (PP), which is excellent in a permeability resistance against the volatile solvent, and is constructed by including the outer filling tube 10 which constructs an outer periphery, an inner filling tube 11 which defines the filling area 1*x* in an inner side of the outer filling tube 10, and the pen tip member which constructs a leading end portion of the filling member 1 for applying the application material M.

As shown in FIG. 11, the outer filling tube 10 is formed by a colored material (for example, black), and has a cylindrical main body portion 103 and a taper portion 10*b* which is continuously provided in a front side of the main body portion 103. The main body portion 10*a* has an annular concave portion 10*c* which engages with the annular protruding portion 2*b* of the main body tube 2 in an axial direction, at the center in the axial direction on its outer peripheral surface. Further, the main body portion 10*a* is provided with an annular collar portion 10*d* which comes into contact with a front end surface of the main body tube 2, in a front side of the annular concave portion 10*c* in its outer peripheral surface. A rear end portion on the outer peripheral surface of the main body portion 10*a* is provided with knurls 10*e* which are provided with a lot of concavo-convex portions side by side in a peripheral direction and are structured such that the concavo-convex portions extend in the axial direction at a predetermined length, as an engaging element with the knurls 2*a* of the main body tube 2 in the rotating direction.

Further, the main body portion 10*a* has hole portions 10*f* as a passage portion (a second passage portion) which communicates air and a part of the application material M, and an element for confirming a filling position of the application material M and engaging the inner filling tube 11. The hole portion 10*f* is formed as a rectangular cross sectional shape, and a pair of hole portions 10*f* are formed at opposed positions to each other on a peripheral wall in a rear end portion of the main body portion 10*a*. The hole portions 10*f* extend in a diametrical direction so as to pass through inner and outer sides of the peripheral wall. As shown in FIGS. 4 and 11, the rear end portion on the inner peripheral surface of the main body portion 102 has an enlarged portion which is formed so that an inner diameter is expanded. The enlarged portion constructs a wall portion (a first wall portion) 10*x* which covers an opening $\mathbf{11}_{out}$ in an opposite side (an outer side of the filling area 1*x*) to the filling area 1*x* side in a hole portion 11*e* of the inner filling tube 11 mentioned later, with a gap. The wall portion 10*x* has a function of guiding a part of the application material M flowing out of the hole portion 11*e* rearward.

The taper portion 10*b* takes on a tapered frustum tubular shape, and is formed as a flat circular shape in its transverse outer shape. An opening 10*g* (refer to FIG. 1) having a flat circular cross sectional shape is formed in a front end portion of the taper portion 10*b*. Further, an O-ring groove 10*h* (refer to FIG. 1) extending annularly is provided in a front side of the collar portion 10*d* on an outer peripheral surface of the main body portion 10*a*, and an O-ring R2 is fitted and installed to the O-ring groove 10*h*, the O-ring R2 serving as an annular elastic body for enhancing an airtightness and a fitting stability within a cap C1 mentioned later.

The inner filling tube 11 is formed by a transparent material, and has a light transmitting property that the application material M in the filling area 1*x* in its inner portion can be seen through. The inner filling tube 11 has a cylindrical main body portion 11*a*, a taper portion 11*b* which is continuously provided in a front side of the main body portion 11*a*, and a front end portion 11*d* which is continuously provided in a front side of the taper portion 11*b* via a step.

The main body portion 11*a* has hole portions 11*e* as a passage portion (a first passage portion) which communicates the air within the filling area 1*x* and a part of the application material M with an outer side of the filling area 1*x*. A pair of hole portions 11*e* are formed at mutually opposed positions on a peripheral wall in a rear end portion of the main body portion 11*a*, and extend in a diametrical direction so as to pass through inner and outer sides of the peripheral wall. Further, the hole portions 11*e* are arranged at the same positions as the hole portions 10*f* in the peripheral direction. The hole portion 11*e* is formed as an oval cross sectional shape which is longer in the axial direction, that is, as a track cross sectional shape which extends at a predetermined length in the axial direction. A rear side of the hole portion 11*e* on the outer peripheral surface of the main body portion 11*a* is provided with a convex portion 11*f* which engages with the hole portion 10*f* of the outer filling tube 10 in the axial direction.

The taper portion 11*b* takes on a tapered frustum tubular shape which is formed as a flat circular shape in its transverse outer shape. The front end portion 11*d* takes on a tubular shape which is formed as a flat circular shape in its transverse outer shape. As shown in FIG. 1, the inner filling tube 11 is inward inserted and installed to the outer filling tube 10. At this time, a gap 11*h* is formed between a front end of the inner filling tube 11 and the outer filling tube 10, and the gap 11*h* constructs an engaging groove for engaging a plug C2 mentioned later.

Figure 12A:
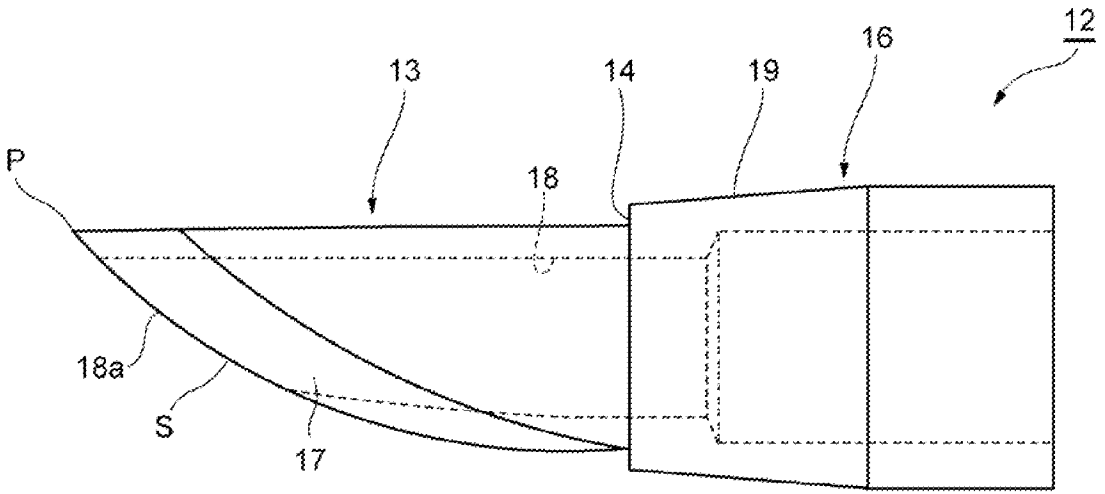
FIG. 12A is a front elevational view showing a pen tip member in the application material extruding container in FIG. 1.
Figure 12B:
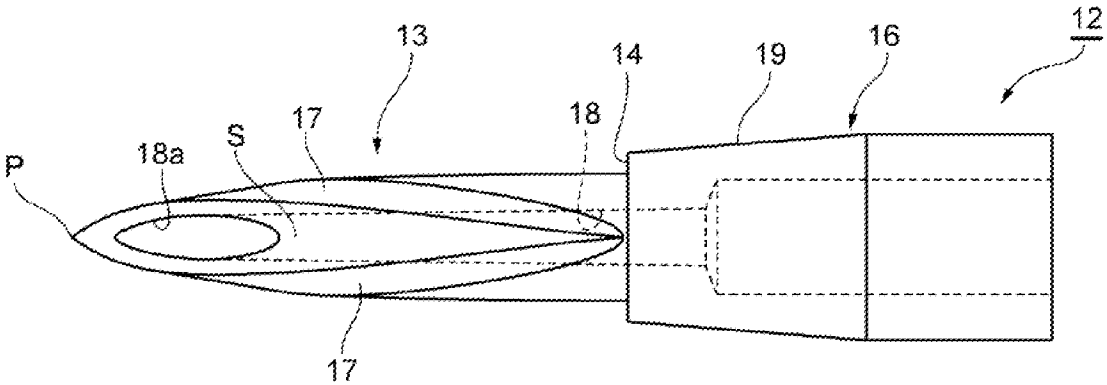
FIG. 12B is a bottom elevational view showing the pen tip member in the application material extruding container in FIG. 1.

FIG. 12A is a front elevational view showing the pen tip member in the application material extruding container in FIG. 1, and FIG. 12B is a bottom elevational view showing the pen tip member in the application material extruding container in FIG. 1. As shown in FIG. 12, the pen tip member 12 is provided for applying the application material M, and is formed by a soft material. As the soft material, for example, there can be employed a general thermosetting rubber which is heated by vulcanization so as to be molded, and a thermoplastic elastomer which is one kind of plastics and is molded by being thermally plasticized and being poured into a metal mold.

As the general rubber, there can be mainly listed up a nitrile rubber (NBR), a butyl rubber (IIR), an ethylene propylene rubber (EPDM), and a silicone rubber (Si). Among them, the nitrile rubber is particularly excellent in an oil resistance against the volatile solvent mentioned above. Further, as the thermoplastic elastomer, there can be mainly listed up a polyester elastomer (TREE), an olefin elastomer (TPO), and an urethane elastomer (TPU). Among them, the urethane elastomer can employ any of two kinds which has a polyurethane as a hard segment and a polyester type and a polyether type as a soft segment, and the polyether type in the soft segment is particularly suitable for the application material M.

Further, in the pen tip member 12, a hardness by a type A durometer defined by JIS K 6253 is preferably set between 40 and 80. As the pen tip member 12, every application portions such as a soft pen tip and the like can be used. As illustrated, the pen tip member 12 includes a sharp pen tip 13 in a leading end side, and a base end portion 16 which is continuously provided via a step portion 14, in a base end side of the pen tip 13.

The pen tip 13 has a flat circular shape in its transverse outer shape, and is formed as a blade shape in a side view. The flat circle in the transverse outer shape is set such that a vertical direction in FIG. 12A is a direction of long axis, and a vertical direction in FIG. 12B is a direction of short axis. In the pen tip 13, an application surface S brought into contact with an applied subject such as a skin of the user is constructed by a leading end surface. The application surface S is formed as a flat circular curved surface which bulges to a front side and is elongated back and forth, and a peak P is formed in a leading end.

Further, a taper surface 17 inclined so as to be tapered to the application surface S side is formed in an area in a base end side at a predetermined length from an outer edge of the application surface S on both side surfaces of the pen tip 13. A through hole 18 which extends along an axial direction and has a circular cross sectional shape is formed at an axial position of the pen tip 13. An opening portion of the application surface S in the through hole 18 forms a discharge port 18*a* for discharging the application material M.

The base end portion 16 takes on a flat circular tubular shape which has a larger diameter than the pen tip 13 in its transverse outer shape. A taper surface 19 inclined so as to be tapered is formed as an engaging element with the taper portion 10*b* of the outer filling tube 10, in an area from a front end to a center on an outer peripheral surface of the base end portion 16.

As shown in FIGS. 1, 11 and 12, the base end portion 16 of the pen tip member 12 is outward inserted to the front end portion 11*d* of the inner filling tube 11, and the pen tip member 12 is engaged with the inner filling tube 11 in the rotating direction so as to be closely attached. In this state, the pen tip member 12 is inward inserted its pen tip 13 to the opening 10*g* of the outer filling tube 10, and is engaged with the outer filling tube 10 in the rotating direction so as to be installed. In other words, the outer filling tube 10, the inner filling tube 11 and the pen tip member 12 are installed to each other as the filling member 1, by assembling the pen tip member 12 in the inner filling tube 11, and assembling it in the outer filling tube 10. Further, the pen tip member 12 is engaged its step portion 14 with the front end portion of the outer filling tube 10 in the axial direction, and is engaged its rear end surface of the base end portion 16 with the inner filling tube 11 in the axial direction, thereby being pinched and retained in the axial direction by the outer filling tube 10 and the inner filling tube 11.

Further, the filling member 1 is inward inserted to the main body tube 2 from its rear portion side, the annular concave portion 10*c* of the outer filling tube 10 is engaged with the annular protruding portion 2*b* of the main body tube 2, and the knurl 10*e* of the outer filling tube 10 is engaged with the knurl 2*a* of the main body tube 2. Accordingly, the filling member 1 is engaged with and installed to the main body tube 2 in the axial direction and the rotating direction, and is integrated with the main body tube 2. In conjunction with this, as in detail described below, in the filling member 1 in which the application material M is filled, the piston 7 is inward inserted and installed to the rear end portion of the inner filling tube 11 so as to be closely attached in an airtight manner.

Further, the plug C2 is fitted and inserted to the discharge port 18*a* of the pen tip member 12 in the filling member 1 so as to be detachably mounted. Accordingly, the filling area 1*x* is hermetically sealed (sealed in an airtight manner). Further, the cap C1 is threadably fitted (detachably mounted) to the outer filling tube 10 of the filling member 1 via the O-ring R2. Accordingly, an inner side of the cap C1 is set to an airtight state. In this case, the threaded tube 4 is inward inserted so that the collar portion 4*a* (refer to FIG. 7) of the threaded tube 4 comes close to an inner surface of the outer filling tube 10 in the filling member 1, thereby inhibiting an inner diameter of the female thread 4*e* from being expanded. Further, the volatilization of the application material M can be further suppressed by attaching the cylindrical cap into the cap C1 so as to reduce a space within the cap C1.

Next, a description will be given in detail of an example of an assembly in the filling member 1 mentioned above.

FIGS. 13 and 14 are vertical cross sectional views for describing the assembly after filling the application material in the application material extruding container. When assembling the filling member 1, first of all, the application material M is filled in the filling area 1*x* of the filling member 1 (an application material filling step). Specifically, the plug C2 serving as a leading end seal part is inserted from the discharge port 18*a* to the leading end portion of the inner filling tube 11, thereby occluding the discharge port 18*a* while setting the plug C2 and the filling member 1 in a closely attached state or in a state having a clearance.

Figure 13A:
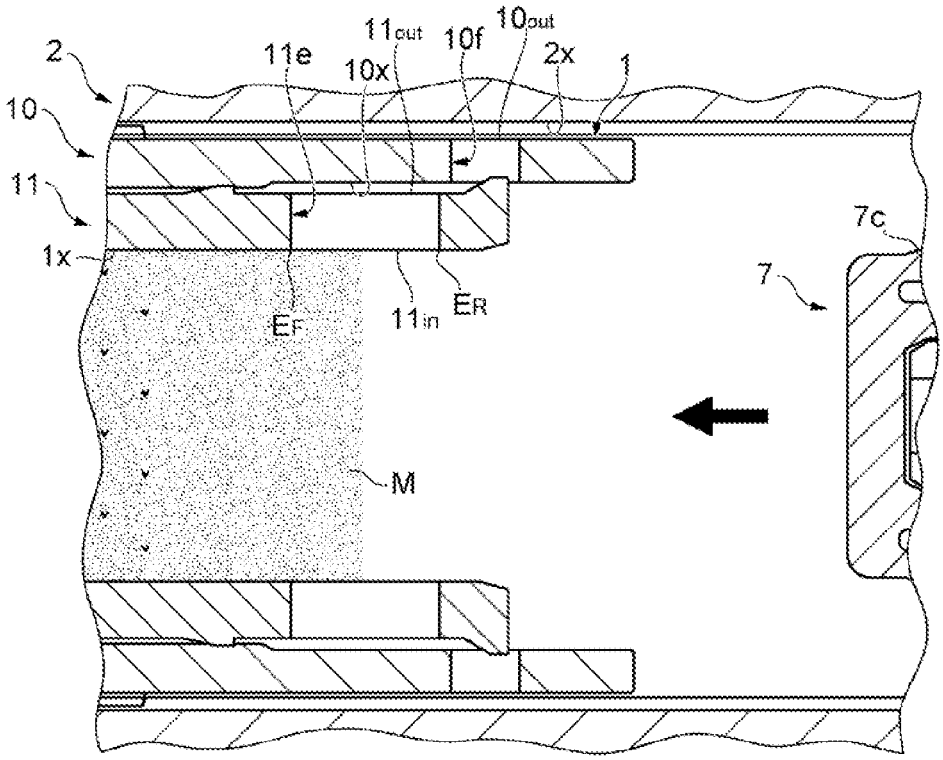
FIG. 13A is a cross sectional view for explaining an assembly of the application material extruding container in FIG. 1.

Subsequently, the filling member is set to a rising posture in which the pen tip member 12 is positioned downward, the application material M which is raised up to a temperature about 80° C. so as to be molten is filled in the inner filling tube 11 from the rear side of the inner filling tube 11, and the filling operation of the application material M is carried out to a fixed amount. For example, as shown in FIG. 13A, the filling operation of the application material M is carried out until the application material M reaches a partway (a center in this case) of an opening $\mathbf{11}_{in}$ of the hole portion 11*e* in the axial direction. In other words, the application material M is filled until a surface of the application material M is positioned between a front end (a front end edge) $E_F$ and a rear end (a rear end edge) $E_R$ of the opening $\mathbf{11}_{in}$ in the filling area 1*x* side which comes to an inner side in the diametrical direction in the hole portion 11*e*. Further, the application material M is cooled by leaving for a predetermined cooling time.

Subsequently, the piston 7 is moved forward from the rear side of the inner filling tube 11, and the piston 7 is inward inserted and installed to the inner filling tube 11 so that the convex portion 7*c* of the piston 7 comes into contact with the inner peripheral surface of the inner filling tube 11 (an extruding portion installing step).

Figure 13B:
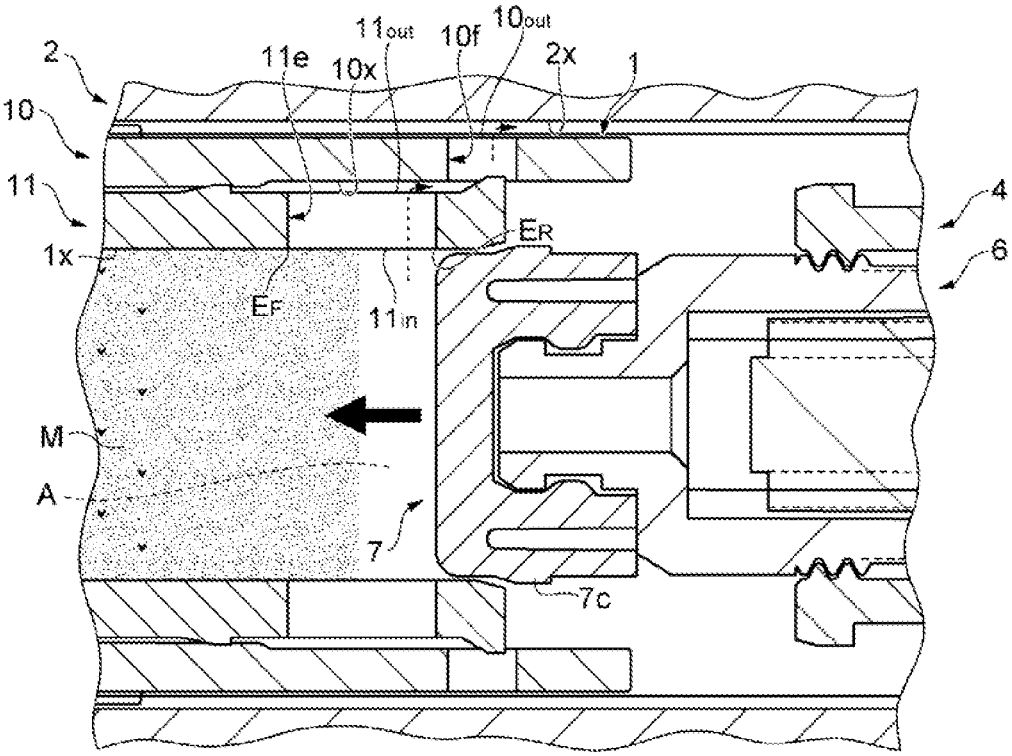
FIG. 13B is a cross sectional view showing subsequence of FIG. 13A.

Here, as shown in FIG. 13B, after the front end surface of the piston 7 comes to the rear end $E_R$ of the opening $\mathbf{11}_{in}$ in the hole portion 11*e*, the air A between the application material M and the piston 7 is positively extruded out of the filling area 1*x* via the hole portion 11*e*. In other words, from the time when the front end of the piston 7 is arranged in front of the rear end $E_R$ of the opening $\mathbf{11}_{in}$, the aft A between the application material M and the piston 7 is positively flowed (exhausted) out of the filling area 1*x* through the hole portion 11*e*. Further, for example, at least a part of the air A passing through the hole portion 11*e* is guided to the wall portion 10*x* so as to flow rearward between the inner filling tube 11 and the outer filling tube 10, and is positively flowed out of the filling member 1 further through the hole portion 10*f*.

Figure 14A:
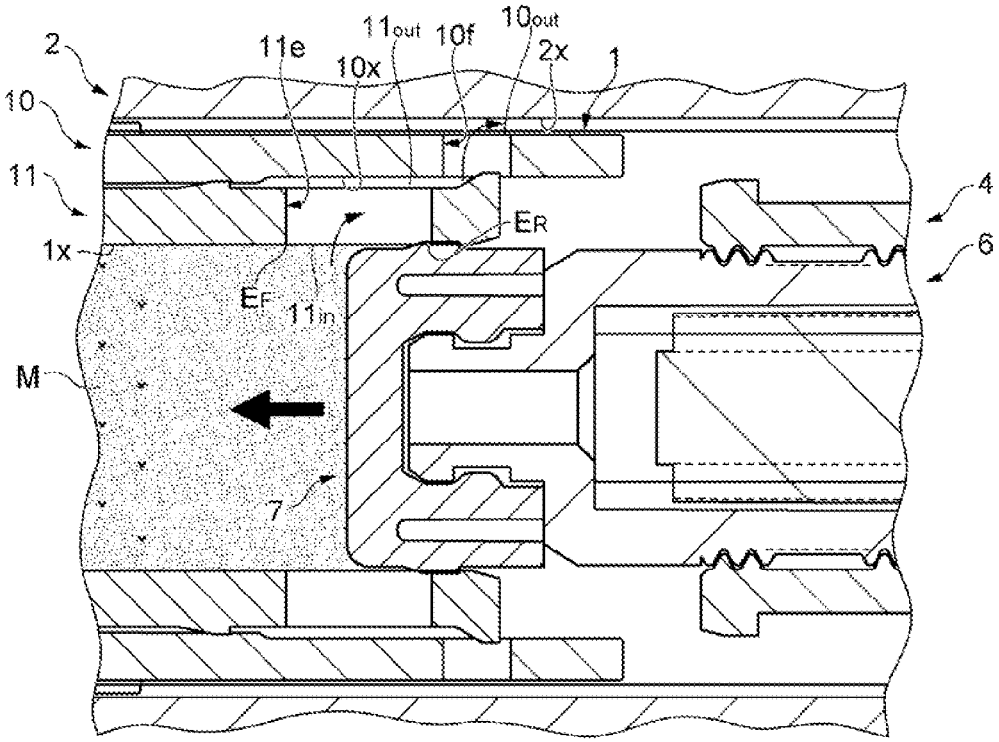
FIG. 14A is a cross sectional view showing subsequence of FIG. 13B.
Figure 14B:
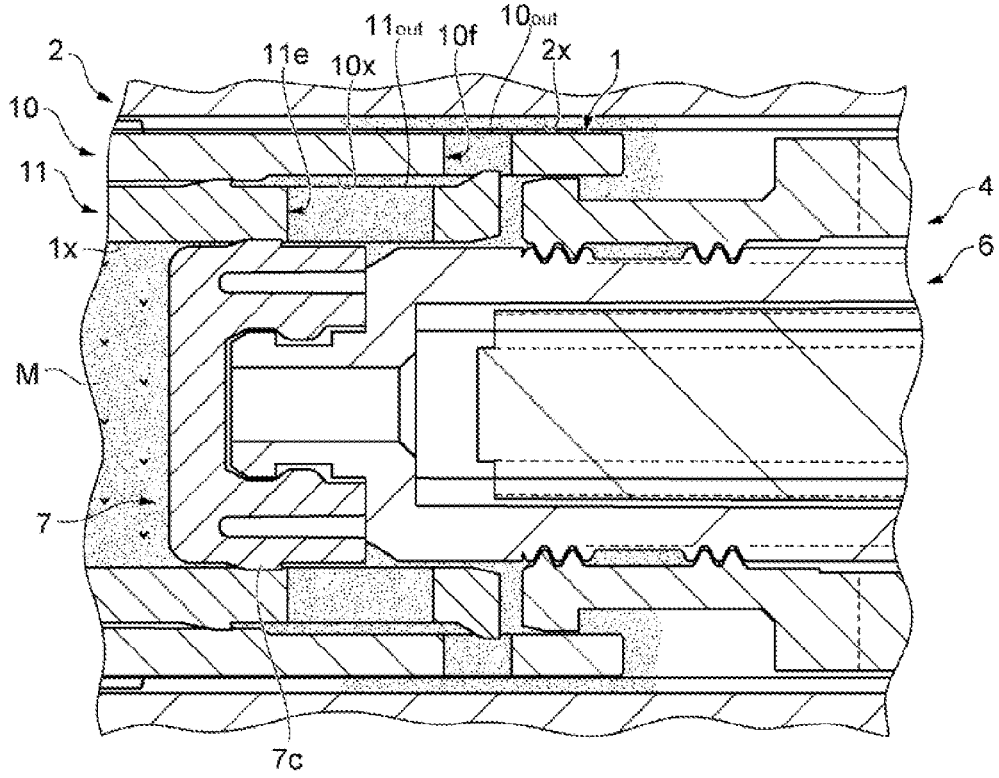
FIG. 14B is a cross sectional view showing subsequence of FIG. 14A.

Further, as shown in FIG. 14A, after the front end surface of the piston 7 reaches the partway of the opening $\mathbf{11}_{in}$ in the axial direction, and the piston 7 comes into contact with the application material M, the application material M is positively extruded out of the filling area 1*x* via the hole portion 11*e*. In other words, from the time when the air A does not stand between the application material M and the piston 7, the application material M is positively flowed out of the filling area 1*x* through the hole portion 11*e*. Further, for example, the application material M passing through the hole portion 11*e* is guided by the wall portion 10*x* so as to flow rearward between the inner filling tube 11 and the outer filling tube 10.

A part of the application material M flowing rearward flows into the threaded tube 4 via the slit 4*f* (refer to FIG. 7) of the threaded tube 4, and reaches the threaded portion 9, and the other portion of the application material M is positively flowed out of the filling member 1 further through the hole portion 10*f*. The application material M passing through the hole portion 10*f* is guided by the wall portion 2*x* so as to flow rearward between the outer filling tube 10 and the main body tube 2, and a part of the application material M flows into the threaded tube 4 via the slit 4*f* of the threaded tube 4 and reaches the threaded portion 9.

Further, after the convex portion 7*c* of the piston 7 is arranged forward beyond the opening $\mathbf{11}_{in}$ and the convex portion 7*c* comes into contact with and is closely attached to the front side of the opening $\mathbf{11}_{in}$ in the inner peripheral surface of the inner filling tube 11, the filling area 1*x* and the hole portion 11*x* are not communicated with each other. Accordingly, the rear end portion of the filling area 1*x* is set to a further airtight state.

As mentioned above, as shown in FIG. 14B, when the installation of the piston 7 is finished, and the piston 7 is positioned at a backward moving limit (a most rearward position in the movable range) as an initial state, a part of the application material M is flowed out of the filling area 1*x* through the hole portion 11*e*. Here, a part of the application material M exists at least in the hole portions 11*e* and 10*f*, between the filling tubes 10 and 11, between the main body tube 2 and the filling member 1, and in the threaded portion 9, within the container.

As mentioned above, in the application material extruding container 100 according to the present embodiment, there comes to a state in which a part of the application material M is flowed out of the filling area 1*x* through the hole portion 11*e*. Accordingly, as mentioned above, when the piston 7 is assembled in the filling member 1, the piston 7 is inward inserted and installed to the filling member 1 while securely discharging the air A between the application material M and the piston 7 out of the filling area 1*x* via the hole portion 11*e*, for example, until the application material M is flowed out of the filling area 1*x* via the hole portion 11*e*.

Therefore, according to the present embodiment, t is possible to more securely inhibit the air A from standing between the application material M and the piston 7. As a result, it is possible to inhibit an internal pressure of the filling area 1*x* from being significantly increased due to a temperature change or the like, and it is possible to prevent the application material M from leaking out of the discharge port 18*a* by itself. In conjunction with this, it is possible to inhibit the air A from coming to a cushion at the extruding time of the application material M so as to generate a time lag. Further, the application material M flowed out of the hole portion 11*e* can be served as a lubricating material for the sliding portion such as the threaded portion 9 within the container 100 by utilizing its oil content. Further, since an extra application material M is discharged from the hole portion 11*e*, it is possible to absorb a filling amount dispersion of the application material M, and it is possible to absorb a capacity dispersion in the filling area 1*x* due to an error of a container dimension.

Further, in the present embodiment, as mentioned above, the opening $\mathbf{11}_{out}$ of the hole portion 11*e* is covered with the wall portion 10*x*, and is structured such that the application material M flowed out of the hole port on 11*e* is guided rearward. Further, the opening $\mathbf{10}_{out}$ of the hole portion 10*f* is covered with the wall portion 2*x*, and is structured such that the application material M flowed out of the hole portion 10*f* is guided rearward. Therefore, it is possible to positively and effectively achieve the operation and effect for functioning the application material M as the lubricating material for the sliding portion within the container 100.

Further, as mentioned above, at least a part of the piston 7 positioned at the rearward moving limit is arranged forward in relation to the rear end $E_R$ of the opening $\mathbf{11}_{in}$ in the inner side of the hole portion 11*e*. Accordingly, when the piston 7 is assembled in the filling member 1, the air A between the application material M and the piston 7 can be further securely discharged out of the filling area 1*x* via the hole portion 11*e*.

Further, in the present embodiment, as mentioned above, in the state in which the piston 7 is positioned at the rearward moving limit, the convex portion 7*c* of the piston 7 is arranged forward beyond the opening $\mathbf{11}_{in}$ of the hole portion 11*e*. Accordingly, it is possible to securely reserve the airtightness of the filling area 1*x*. The effect mentioned above is particularly effective since the volatilization of the application material M can be preferably suppressed in the case that the application material M has a volatility like the present embodiment.

Further, in the present embodiment, as mentioned above, the front end surface of the piston 7 is formed as the flat surface shape. Accordingly, it is possible to smoothly circulate the air A ad the application material M (inhibit the circulation from being blocked by the shape of the piston 7) at a time when the piston 7 extrudes the air A between the piston 7 and the application material M, and the application material M out of the hole portion 11*e*, and it is possible to further securely inhibit the air A from standing between the application material M and the piston 7.

Further, in the present embodiment, since the hole portion 11*e* is formed longer in the axial direction, an allowable range of the filling amount can be enlarged in the case that the application material M is filled to the partway of the opening $\mathbf{11}_{in}$ of the hole portion 11*e* in the inner filling tube 11, and it is possible to easily fill the application material M. In other words, even in the case that the filling amount of the application material M is dispersed, the application material M can be securely filled to the partway of the opening $\mathbf{11}_{in}$ of the hole portion 11*e*.

Further, the application material M like the present embodiment is generally filled in a jar type glass container and is used by a cosmetic brush. However, in this case, in a wide mouthed jar type container, for example, the application material M is quickly volatilized and the application material M tends to be changed, and there is a problem that a brush end is solidified and is hard to be used. In this regard, in the present embodiment, since the open part is reduced and the application material M can be doubly or triply sealed and protected by the resin material having a high barrier performance, the present embodiment is advantageous in the case that the application material M including a lot of volatile components is used.

Figure 15:
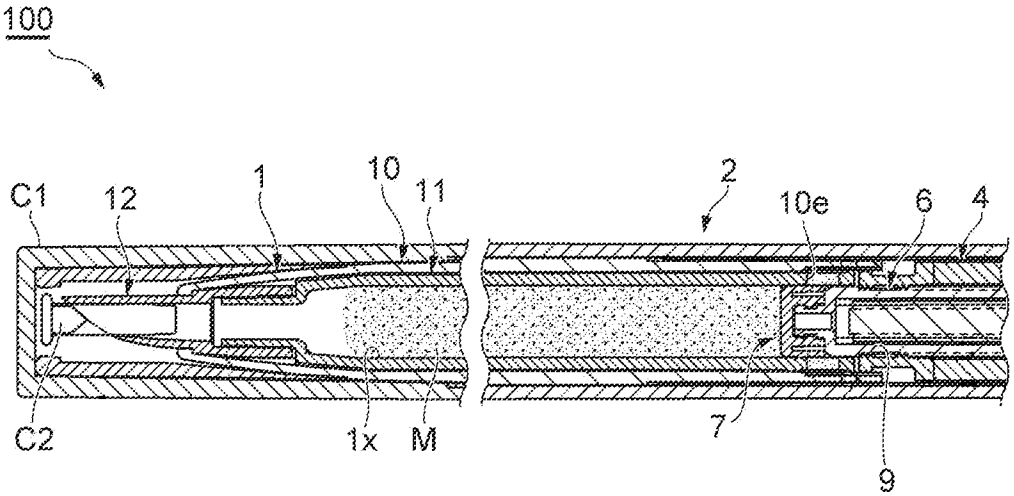
FIG. 15 is an X-ray photograph showing a part of the application material extruding container in FIG. 1.

FIG. 15 is an X-ray photograph showing a part of the application material extruding container in FIG. 1. As shown in FIG. 15, in the application material extruding container 100 according to the present embodiment, a part of the application material M is flowed out of the filling area 1*x* through the hole portion 11*e*, and further reaches the threaded portion 9, in the initial state in which the piston 7 is positioned at the rearward moving limit, so that it is possible to confirm that the air A is securely inhibited from standing between the application material M and the piston 7.

In the application material extruding container 100 which is structured as mentioned above and is in the initial state shown in FIG. 1, when the cap C1 and the plug C2 are detached by the user, and the main body tube 2 and the control tube 3 are relatively rotated in one direction corresponding to the feeding direction, the moving body 6 and the piston 7 move forward on the basis of the cooperation of the threaded portion 9 constructed by the female thread 4*e* of the threaded tube 4 and the male thread 6*b* of the moving body 6, and the rotation preventing portion constructed by the protruding ridge 3*d* of the control tube 3 and the protruding ridge 6*c* of the moving body 6, whereby the application material M filled in the filling area 1*x* of the filling member 1 is discharged out of the discharge port 18*a* of the pen tip member 12 (refer to FIG. 2).

Further, when the main body tube 2 and the control tube 3 are relatively rotated in one direction as mentioned above, the ratchet teeth 8*b* are energized forward in the axial direction on the basis of the elastic force of the spring portion 5*b* of the ratchet member 5. Accordingly, the engagement and the disengagement (the threadable connection and the threadable disconnection) of the ratchet teeth 8*a* and 8*b* in the ratchet mechanism 8 are repeated. In other words, the side surfaces 8*a*1 (refer to FIG. 7) of the ratchet teeth 8*a* engage with the side surfaces 8*b*1 (refer to FIG. 9) of the ratchet teeth 8*b* in the rotating direction, and the ratchet teeth 8*a* slide so as to run up on the side surfaces 8*b*1 of the ratchet teeth 8*b*. Further, after the ratchet teeth 8*a* go beyond the ratchet teeth 8*b* and the engagement is canceled, the side surfaces 8*a*1 reengage with the side surfaces 8*b*1 in the rotating direction. As a result, a click feeling is applied to the user every time the ratchet teeth 8*a* and 8*b* engage and disengage. Here, the click feeling is generated one time in the case that the main body tube 2 and the control tube 3 are relatively rotated in one direction at one eighth turn (45 degrees).

On the other hand, even if the main body 2 and the control tube 3 are intended to be relatively rotated in the other direction corresponding to the feed-back direction, the side surfaces 8*a*2 (refer to FIG. 7) of the ratchet teeth 8*a* come into contact with the side surfaces 8*b*2 (refer to FIG. 9) of the ratchet teeth 8*b* so as to be locked in the rotating direction, and the relative rotation is controlled so that the threaded tube 4 and the ratchet member 5 do not relatively rotate. As a result, the main body tube 2 and the control tube 3 are not relatively rotated in the other direction.

In this connection, as shown in FIGS. 6 and 7, the application material extruding container 100 is provided with the cam mechanism 20 mentioned above. The cam mechanism 20 moves backward the moving body 7 and the piston 7 at a fixed stroke after moving forward the moving body 6 and the piston 7 at a fixed stroke, on the basis of the relative rotation at a fixed rotating amount of the main body tube 2 and the control tube 3 in one direction. In this case, every time the main body tube 2 and the control tube 3 are relatively rotated at one eighth turn (every time the click feeling is generated one time), the moving body 6 and the piston 7 are moved forward at 1.2 mm. The cam mechanism 20 is provided with the protruding portion 20*a*, and the guide portion 20*b* which is constructed by the bulge portion 20*c* and the guide piece 20*d*, as mentioned above, the protruding portion 20*a* is relatively guided by the guide portion 20*b*, and the protruding portion 20*a* relatively moves along a relative locus extending along a sine curve.

The cam mechanism 20 converts a rotating force of the relative rotation into a linear moving force along the axial direction every time the main body tube 2 and the control tube 3 are relatively rotated at a fixed rotating amount, thereby moving forward the moving body 6 and the piston 7 at a fixed stroke. Specifically, when the main body tube 2 and the control tube 3 are relatively rotated in one direction, first of all, the protruding portion 20*a* relatively moves to one side in the peripheral direction, and a rear sliding surface 20*a*2 of the protruding portion 20*a* comes into contact with a guide surface 20*f* of the guide piece 20*d* so as to slide. Accordingly, since the guide piece 20*d* (the threaded tube 4) is movable in the axial direction in relation to the main body tube 2 and is engaged in the rotating direction, the guide piece 20*d* is pushed rearward by the protruding portion 20*a*, and the guide piece 20*d* moves backward. Accordingly, the threaded tube 4 moves backward, the moving body 6 threadably engaged with the threaded tube 4 by the threaded portion 9 moves backward, and the piston 7 further moves backward. As a result, the filling area 1*x* is expanded and the internal pressure of the filling area 1*x* is automatically depressurized.

When being relatively rotated in the one direction continuously, the protruding portion 20*a* relatively moves continuously to the one side in the peripheral direction, and the threaded tube 4, the moving body 6 and the piston 7 move backward continuously. Further, when the protruding portion 20*a* relatively moves to a position where the protruding portion 20*a* comes into contact with an edge portion in one side in the peripheral direction of the guide surface 20*f*, the sliding motion of the protruding portion 20*a* with the guide surface 20*f* is finished, and the threaded tube 4, the moving body 6 and the piton 7 reach a backmost position in the cam mechanism 20. At this time (when reaching the backmost position of the cam mechanism 20), the ratchet teeth 8*a* climbs over the ratchet teeth 8*b*, and the ratchet teeth 8*a* and 8*b* are disengaged and engaged, whereby the click feeling is generated (refer to FIG. 1).

Further, when being relatively rotated in the one direction continuously, the protruding portion 20*a* relatively moves to the one side in the peripheral direction, and the front sliding surface 20*a*1 of the protruding portion 20*a* comes into contact with the guide surface 20*e* of the bulge portion 20*c* so as to slide. Accordingly, the bulge portion 20*c* is pushed forward by the protruding portion 20*a*, and the bulge portion 20*c* moves forward. Accordingly, the threaded tube 4 moves forward, and the moving body 6 and the piston 7 move forward. As a result, the filling area 1*x* is contracted, and the application material M within the filling area 1*x* is extruded so as to be discharged out of the discharge port 18*a*.

When being relatively rotated in the one direction further continuously, the protruding portion 20*a* further relatively moves to the one side in the peripheral direction continuously, and the threaded tube 4, the moving body 6 and the piston 7 move forward continuously. Further, when the protruding portion 20*a* relatively moves to a position where the protruding portion 20*a* comes into contact with an edge portion in one side in the peripheral direction of the guide surface 20*e*, the sliding motion of the protruding portion 20*a* with the guide surface 20*e* is finished, and the threaded tube 4, the moving body 6 and the piston 7 reaches a most forward moving position in the cam mechanism 20. As mentioned above, the moving body 6 and the piston 7 are moved backward at the fixed stroke.

Accordingly, in the application material extruding container 100 according to the present embodiment, in addition to the operations and effects mentioned above, the following operations and effects can be further achieved. In other words, the inner side of the filling area 1*x* can be automatically depressurized as well as the application material M is discharged, by relatively rotating the main body tube 2 and the control tube 3 at the fixed rotating amount in the one direction and moving forward the moving body 6 and the piston 7 at the fixed stroke by the cam mechanism 20. Since the inner side of the filling area 1*x* can be automatically depressurized as mentioned above, it is possible to easily and securely inhibit the application material M from leaking, that is, inhibit the application material M from drooping from the discharge port 18*a*, for example, due to passage of time. Further, it is possible to inhibit the application material M from being changed by the pressure.

Particularly, in the present embodiment, the cam mechanism 20 can move forward and backward the moving body 6 and the piston 7 only by the rotating force of the relative rotation, without depending on the energizing force of the elastic body such as the spring or the like. Since the energizing force of the elastic body may be insufficient in comparison with the force necessary for moving forward and backward the moving body 6 and the piston 7, it is possible to further securely inhibit the application material M from leaking, according to the present embodiment mentioned above. Further, since the piston 7 defining the filling area 1*x* can be moved forward and backward by the cam mechanism 20, it is possible to directly and preferably depressurize the filling area 1*x*.

Further, in the present embodiment, as mentioned above, every time the click feeling is generated one time by the relative rotation of the main body tube 2 and the control tube 3, the moving body 6 and the piston 7 move forward and backward at the fixed stroke. Accordingly, as well as making the user feel a degree of the relative rotation and a discharge degree of the application material M on the basis of the click feeling, it is possible to make the user feel the forward and backward movement at the fixed stroke of the moving body 6 and the piston 7.

Further, according to the present embodiment, as mentioned above, the relative rotation of the main body tube 2 and the control tube 3 in the other direction can be controlled by the ratchet mechanism 8, and only the relative rotation of the main body tube 2 and the control tube 3 in the one direction can be allowed by the ratchet mechanism 8.

Further, in the present embodiment, as mentioned above, when the click feeling is generated, the threaded tube 4 is positioned at the rearmost position of the cam mechanism 20, and the inner side of the filling area 1*x* is depressurized to the maximum. Accordingly, since the user generally stops the relative rotation (finishes the use) on the basis of the click feeling, the application material extruding container 100 after being used tends to be set to a state in which the filling area 1*x* is depressurized. In this regard, under an actual condition that the application material M particularly tends to leak out of the discharge port 18*a* at a storage time after using, the present embodiment which can depressurize the filling area 1*x* of the used application material extruding container 100 to the maximum is advantageous.

In the present embodiment, the inner filling tube 11 may be made transparent, and a window may be formed in a part (a position which can view the piston 7 at a time when the piston 7 is positioned at the position shown in FIG. 2 corresponding to the forward moving limit of the moving body 6) of the outer filling tube 10. In this case, the color tone and existence of the filled application material M can be confirmed by detaching the cap C1 at a selling time or a using time. For example, in the case that the piston 7 is formed by a white color, the color viewed from the window changes from the color of the application material M to the white color when the application material M is extruded to the end and the piston 7 reaches the position of the window formed in the outer filling tube 10. Therefore, no remaining amount can be recognized, and the end of use is signed.

As mentioned above, the description is given of the preferable embodiments according to the present invention, however, the present invention is not limited to the embodiments mentioned above, but can be modified within a range which does not deflect from the scope described in each of the claims, or can be applied to the other structures.

Figure 16:
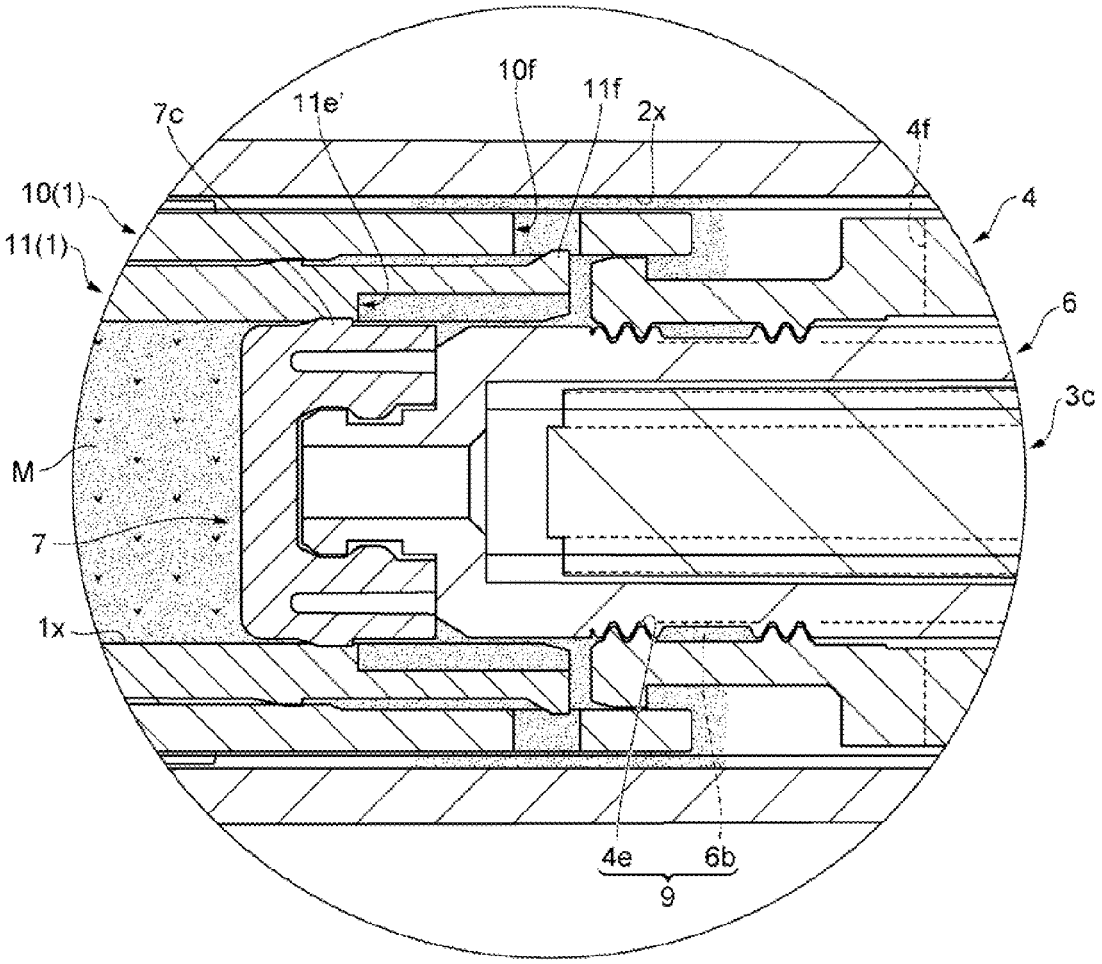
FIG. 16 is a cross sectional view showing a substantial part of an application material extruding container according to a modified embodiment in an enlarged manner.

For example, in the embodiment mentioned above, a pair of oval hole portions 11*e* are provided as the passage portion, however, the passage portion may be formed as a circular (completely circular) shape or a polygonal shape, and one or three or more passage portions may be provided. Further, the passage portion is not limited to the hole portion which passes through the peripheral wall of the inner filling tube 11, but may be constructed by a groove portion 11*e*' (a concave portion) which is formed in the inner peripheral surface of the inner filling tube 11 and extends so as to be open to the rear end surface of the inner filling tube 11, for example, as shown in FIG. 16. In this case, a bottom surface of the groove portion 11*e*' can achieve the function provided by the wall portion 10*x* (that is, the function of guiding the application material M rearward). Further, the passage portion may be structured such as to include the hole portion and the groove portion.

Further, in the embodiment mentioned above, the application material M is filled to the partway of the opening $\mathbf{11}_{in}$ of the hole portion 11*e* within the inner filling tube 11, however, the filling material M may be filled to a rear side beyond the opening $\mathbf{11}_{in}$ of the hole portion 11*e* in the inner filling tube 11 without being limited to this, or the filling material M may be filled to a front side which does not reach the opening $\mathbf{11}_{in}$.

Further, in the embodiment mentioned above, the extruding mechanism employs the rotary type by the threaded portion 9, however, can employ a mechanical extruding mechanism, for example, a knocking type, and a squeeze type extruding mechanism without being limited to this. Further, in the embodiment mentioned above, the extruding portion employs the piston 7 having the flat shaped front end surface, however, may employ a bell-shaped piston which is tapered toward a front side, and can employ various extruding portions. Further, in the embodiment mentioned above, the cam mechanism 20 employs the cylindrical cam mechanism, however, can of course employ the other cam mechanisms.

Further, the male thread and the female thread mentioned above, may work in the same manner as a screw thread and a screw groove like intermittently arranged projection groups or spirally and intermittently arranged projection groups, in addition to the screw thread and the screw groove. Further, in the present embodiment, the spring portion 5*b* is integrally provided with the ratchet member 5, however, the spring portion 5*b* may be provided separately from the ratchet member 5. In the above, the ratchet mechanism 8 doubles as the click mechanism, and the ratchet teeth 8*a* and 8*b* correspond to a pair of click projections (click teeth).

Further, in the embodiment mentioned above, the description is given of the present invention as the application material extruding container 100, however, the present invention can be comprehended as a manufacturing method for manufacturing the application material extruding container 100. Further, in the embodiment mentioned above, there can be included further a step of moving (approaching) the application material M within the filling area 1*x* rearward so that the air A does not stand between the application material M and the piston 7, by pressurizing or mechanically extruding rearward the discharge port 18*a* side of the filling area 1*x*, after filling the application material M and before installing the piston 7 (after the application material filling step and before the extruding portion installing step).

Effect of the Invention

According to the present invention, there can be provided the application material extruding container which can more securely inhibit the air from standing between the application material and the extruding portion.

What is claimed is:

1. An application material extruding container comprising:

a filling member comprising an inner filling tube having a filling area filled with an application material, and an outer filling tube to which the inner filling tube is inward inserted;

an extruding portion which is inward inserted to the inner filling tube of the filling member so as to be in close contact with an inner surface of the inner filling tube and constructs a rear end of said filling area; and the application material extruding container discharging said application material from a discharge port in a leading end side of the container on the basis of a forward movement of said extruding portion, wherein the inner filling tube has hole portions extending from the filling area to an inside of the outer filling tube, while forming a first passage, wherein the outer filling tube has hole portions so as to be communicated with an external side of the outer filling tube, while forming a second passage, wherein said first and second passages define a passage portion which is provided in said filling member and extends so as to be communicated with the external side of said outer filling tube in said container from said filling area, and wherein a part of said application material is flowed out of said filling area through said passage portion on the basis of the forward movement of said extruding portion.

2. The application material extruding container according to claim 1, wherein a wall portion is further provided within said container, and wherein said wall portion covers an opening of each hole portion of the inner filling tube in an outer side of said filling area in said passage portion so that a part of said application material flowed out of said hole portion is guided rearward.

3. The application material extruding container according to claim 2, wherein said passage portion includes a groove portion which is formed in the inner surface of said inner filling tube and extends so as to be open to the rear end of the inner filling tube.

4. The application material extruding container according to claim 3, wherein at least a part of said extruding portion is arranged in front of a rear end of an opening of each hole portion of the inner filling tube closer to said filling area in said passage portion, in a state in which said extruding portion is positioned at a backward moving limit.

5. The application material extruding container according to claim 2, wherein at least a part of said extruding portion is arranged in front of a rear end of an opening of each hole portion of the inner filling tube closer to said filling area in said passage portion, in a state in which said extruding portion is positioned at a backward moving limit.

6. The application material extruding container according to claim 1, wherein said passage portion includes a groove portion which is formed in the inner surface of said inner filling tube and extends so as to be open to the rear end of the inner filling tube.

7. The application material extruding container according to claim 6, wherein at least a part of said extruding portion is arranged in front of a rear end of an opening of each hole portion of the inner filling tube closer to said filling area in said passage portion, in a state in which said extruding portion is positioned at a backward moving limit.

8. The application material extruding container according to any one of claims 1, 2, 6 and 3, wherein a front end of an area coming into close contact with said inner surface of the inner filling tube in said extruding portion is arranged forward beyond an opening of each hole portion of the inner filling tube closer to said filling area in said passage portion, in a state in which said extruding portion is positioned at the backward moving limit.

9. The application material extruding container according to claim 8, wherein said application material has a volatile.

10. The application material extruding container according to claim 1, wherein at least a part of said extruding portion is arranged in front of a rear end of an opening of each hole portion of the inner filling tube closer to said filling area in said passage portion, in a state in which said extruding portion is positioned at a backward moving limit.

11. An application material extruding container comprising:

a filling member which has a filling area filled with an application material;

an extruding portion which is inward inserted to the filling member so as to be in close contact with the filling member and constructs a rear end of said filling area; and the application material extruding container discharging said application material from a discharge port in a leading end side of the container on the basis of a forward movement of said extruding portion, wherein the application material extruding container comprises a passage portion which is provided in said filling member and extends so as to be communicated with an external side of said filling member in said container from said filling area, wherein a part of said application material is flowed out of said filling area through said passage portion, and wherein said passage portion includes a groove portion which is formed in an inner surface of said filling member and extends so as to be open to the rear end of the filling member.

12. The application material extruding container according to claim 11, wherein at least a part of said extruding portion is arranged in front of a rear end of an opening closer to said filling area in said passage portion, in a state in which said extruding portion is positioned at a backward moving limit.

13. The application material extruding container according to claim 11, wherein a front end of an area coming into close contact with said filling member in said extruding portion is arranged forward beyond an opening closer to said filling area in said passage portion, in a state in which said extruding portion is positioned at the backward moving limit.

14. The application material extruding container according to claim 13, wherein said application material has a volatile.

15. An application material extruding container comprising:

a filling member which has a filling area filled with an application material;

an extruding portion which is inward inserted to the filling member so as to be in close contact with the filling member and constructs a rear end of said filling area; and the application material extruding container discharging said application material from a discharge port in a leading end side of the container on the basis of a forward movement of said extruding portion, wherein the application material extruding container comprises a passage portion which is provided in said filling member and extends so as to be communicated with an external side of said filling member in said container from said filling area, wherein a part of said application material is flowed out of said filling area through said passage portion, and wherein at least a part of said extruding portion is arranged in front of a rear end of an opening closer to said filling area in said passage portion, in a state in which said extruding portion is positioned at a backward moving limit.

* * * * *